US011300364B2

(12) United States Patent
Erb et al.

(10) Patent No.: US 11,300,364 B2
(45) Date of Patent: Apr. 12, 2022

(54) MEMBRANE-INTEGRATED ENERGY EXCHANGE ASSEMBLY

(71) Applicant: Nortek Air Solutions Canada, Inc., Saskatoon (CA)

(72) Inventors: Blake Norman Erb, Warman (CA); Stephen Harold Hanson, Saskatoon (CA); Mohammad Afshin, Saskatoon (CA)

(73) Assignee: Nortek Air Solutions Canada, Inc., Saskatoon (CA)

( * ) Notice: Subject to any disclaimer, the term of this patent is extended or adjusted under 35 U.S.C. 154(b) by 215 days.

(21) Appl. No.: 16/431,397

(22) Filed: Jun. 4, 2019

(65) Prior Publication Data

US 2019/0346212 A1 Nov. 14, 2019

Related U.S. Application Data

(63) Continuation of application No. 14/190,715, filed on Feb. 26, 2014, now Pat. No. 10,352,628.
(Continued)

(51) Int. Cl.
*F28D 21/00* (2006.01)
*F28F 9/00* (2006.01)
*F28D 9/00* (2006.01)

(52) U.S. Cl.
CPC ..... *F28D 21/0015* (2013.01); *F28D 9/0062* (2013.01); *F28D 21/0008* (2013.01);
(Continued)

(58) Field of Classification Search
CPC ..... F28D 21/0015; F28D 9/0062; F28D 21/0008; F28D 21/0014; F28F 9/001; F28F 2255/143
See application file for complete search history.

(56) References Cited

U.S. PATENT DOCUMENTS 1,015,831 A 1/1912 Pielock et al.
2,186,844 A 1/1940 Smith
(Continued)

FOREIGN PATENT DOCUMENTS

AU 2011286700 A1 12/2012
AU 2011268661 A1 1/2013
(Continued)

OTHER PUBLICATIONS

"AAONAIRE Energy Recovery Units Users Information Manual", AAON, Inc., (Aug. 2006), 16 pgs.
(Continued)

*Primary Examiner* — Jon T. Schermerhorn, Jr.
(74) *Attorney, Agent, or Firm* — Schwegman Lundberg & Woessner, P.A.

(57) ABSTRACT

A method of forming a membrane panel configured to be secured within an energy exchange assembly may include forming an outer frame defining a central opening, and integrating a membrane sheet with the outer frame. The membrane sheet spans across the central opening, and is configured to transfer one or both of sensible energy or latent energy therethrough. The integrating operation may include injection-molding the outer frame to edge portions of the membrane sheet. Alternatively, the integrating operation may include laser-bonding, ultrasonically bonding, heat-sealing, or the like, the membrane sheet to the outer frame.

22 Claims, 9 Drawing Sheets

Related U.S. Application Data

(60) Provisional application No. 61/783,048, filed on Mar. 14, 2013.

(52) U.S. Cl.
CPC ..... *F28D 21/0014* (2013.01); *F28F 9/001* (2013.01); *F28F 2255/143* (2013.01); *Y10T 156/10* (2015.01)

(56) References Cited

U.S. PATENT DOCUMENTS 2,290,465 A 7/1942 Crawford et al.
2,562,811 A 7/1951 Glenn
2,946,201 A 7/1960 Munters
2,968,165 A 1/1961 Gunnar
3,009,684 A 11/1961 Georg
3,018,231 A 1/1962 Valentine et al.
3,144,901 A 8/1964 Meek
3,247,679 A 4/1966 Gershon
3,291,206 A 12/1966 Peter
3,401,530 A 9/1968 Gershon
3,467,072 A 9/1969 Toesca
3,735,559 A 5/1973 Salemme
4,011,731 A 3/1977 Meckler
4,113,004 A 9/1978 Rush et al.
4,180,985 A 1/1980 Northrup, Jr.
4,233,796 A 11/1980 Mazzoni et al.
4,235,081 A 11/1980 Dowling
4,257,169 A 3/1981 Pierce
4,259,849 A 4/1981 Griffiths
4,373,347 A 2/1983 Howell et al.
4,380,910 A 4/1983 Hood et al.
4,430,864 A 2/1984 Mathiprakasam
4,434,845 A * 3/1984 Steeb ..... F28D 9/0062 165/153
4,474,021 A 10/1984 Harband
4,538,426 A 9/1985 Bock
4,594,860 A 6/1986 Coellner et al.
4,691,530 A 9/1987 Meckler
4,700,550 A 10/1987 Rhodes
4,719,761 A 1/1988 Cromer
4,723,417 A 2/1988 Meckler
4,729,428 A 3/1988 Yasutake et al.
4,729,774 A 3/1988 Cohen et al.
4,841,733 A 6/1989 Dussault et al.
4,887,438 A 12/1989 Meckler
4,900,448 A 2/1990 Bonne et al.
4,905,479 A 3/1990 Wilkinson
4,909,810 A 3/1990 Nakao et al.
4,930,322 A 6/1990 Ashley et al.
4,936,107 A 6/1990 Kitagaki et al.
4,939,906 A 7/1990 Spatz et al.
4,941,324 A 7/1990 Peterson et al.
4,982,575 A 1/1991 Besik
5,003,961 A 4/1991 Besik
5,020,334 A 6/1991 Wilkinson
5,020,335 A 6/1991 Albers et al.
5,022,241 A 6/1991 Wilkinson
5,120,445 A 6/1992 Colman
5,131,238 A 7/1992 Meckler
5,148,374 A 9/1992 Coellner
5,170,633 A 12/1992 Kaplan
5,176,005 A 1/1993 Kaplan
5,181,387 A 1/1993 Meckler
5,191,771 A 3/1993 Meckler
5,297,398 A 3/1994 Meckler
5,311,929 A 5/1994 Verret
5,325,676 A 7/1994 Meckler
5,337,574 A 8/1994 Dick
5,351,497 A 10/1994 Lowenstein
5,353,606 A 10/1994 Yoho et al.
5,373,704 A 12/1994 Mcfadden
5,387,376 A 2/1995 Gasser
5,448,895 A 9/1995 Coellner et al.
5,471,852 A 12/1995 Meckler
5,482,625 A 1/1996 Shimizu et al.
5,496,397 A 3/1996 Fischer et al.
5,502,975 A 4/1996 Brickley et al.
5,517,828 A 5/1996 Calton et al.
5,526,651 A 6/1996 Worek et al.
5,542,968 A 8/1996 Belding et al.
5,551,245 A 9/1996 Calton et al.
5,564,281 A 10/1996 Calton et al.
5,579,647 A 12/1996 Calton et al.
5,580,369 A 12/1996 Belding et al.
5,632,954 A 5/1997 Coellner et al.
5,638,900 A 6/1997 Lowenstein et al.
5,649,428 A 7/1997 Calton et al.
5,650,221 A 7/1997 Belding et al.
5,653,115 A 8/1997 Brickley et al.
5,660,048 A 8/1997 Belding et al.
5,661,983 A 9/1997 Groten et al.
5,685,897 A 11/1997 Belding et al.
5,701,762 A 12/1997 Akamatsu et al.
5,718,286 A 2/1998 Damsohn et al.
5,727,394 A 3/1998 Belding et al.
5,732,562 A 3/1998 Moratalla
5,749,230 A 5/1998 Coellner et al.
5,758,508 A 6/1998 Belding et al.
5,758,511 A 6/1998 Yoho et al.
5,761,915 A 6/1998 Rao
5,761,923 A 6/1998 Maeda
5,791,153 A 8/1998 Belding et al.
5,791,157 A 8/1998 Maeda
5,816,065 A 10/1998 Maeda
5,825,641 A 10/1998 Mangtani
5,826,434 A 10/1998 Belding et al.
5,826,641 A 10/1998 Bierwirth et al.
5,832,736 A 11/1998 Yoshioka et al.
5,860,284 A 1/1999 Goland et al.
5,890,372 A 4/1999 Belding et al.
5,911,273 A 6/1999 Brenner et al.
5,931,016 A 8/1999 Yoho
5,943,874 A 8/1999 Maeda
5,946,931 A 9/1999 Lomax et al.
5,950,447 A 9/1999 Maeda et al.
5,992,160 A 11/1999 Bussjager et al.
6,003,327 A 12/1999 Belding et al.
6,018,953 A 2/2000 Belding et al.
6,018,954 A 2/2000 Assaf
6,029,462 A 2/2000 Denniston
6,029,467 A 2/2000 Moratalla
6,050,100 A 4/2000 Belding et al.
6,079,481 A 6/2000 Lowenstein et al.
6,094,835 A 8/2000 Cromer
6,138,470 A 10/2000 Potnis et al.
6,141,979 A 11/2000 Dunlap
6,145,588 A 11/2000 Martin et al.
6,156,102 A 12/2000 Conrad et al.
6,176,101 B1 1/2001 Lowenstein
6,178,762 B1 1/2001 Flax
6,199,388 B1 3/2001 Fischer
6,199,392 B1 3/2001 Maeda
6,237,354 B1 5/2001 Cromer
6,269,650 B1 8/2001 Shaw
6,318,106 B1 11/2001 Maeda
RE37,464 E 12/2001 Meckler
6,363,218 B1 3/2002 Lowenstein et al.
6,412,295 B2 7/2002 Weiss et al.
6,442,951 B1 9/2002 Maeda et al.
6,494,053 B1 12/2002 Forkosh
6,497,107 B2 12/2002 Maisotsenko et al.
6,532,763 B1 3/2003 Gupte
6,546,746 B2 4/2003 Forkosh et al.
6,568,466 B2 5/2003 Lowenstein et al.
6,575,228 B1 6/2003 Ragland et al.
6,598,862 B2 7/2003 Merrill et al.
6,635,104 B2 10/2003 Komkova et al.
6,644,059 B2 11/2003 Maeda et al.
6,684,649 B1 2/2004 Thompson
6,709,492 B1 3/2004 Spadaccini et al.
6,720,990 B1 4/2004 Walker et al.
6,739,142 B2 5/2004 Korin

(56) References Cited

U.S. PATENT DOCUMENTS 6,745,826 B2 6/2004 Lowenstein et al.
6,751,964 B2 6/2004 Fischer
6,800,118 B2 10/2004 Kusunose et al.
6,841,601 B2 1/2005 Serpico et al.
6,848,265 B2 2/2005 Lowenstein et al.
6,854,278 B2 2/2005 Maisotsenko et al.
6,864,005 B2 3/2005 Mossman
6,935,416 B1 8/2005 Tsunoda et al.
6,973,795 B1 12/2005 Moffitt
6,976,365 B2 12/2005 Forkosh et al.
6,978,633 B2 12/2005 Yamazaki
7,000,427 B2 2/2006 Mathias et al.
7,017,356 B2 3/2006 Moffitt
7,092,006 B2 8/2006 Walker et al.
7,093,452 B2 8/2006 Chee et al.
7,093,649 B2 8/2006 Dawson
RE39,288 E 9/2006 Assaf
7,178,355 B2 2/2007 Moffitt
7,181,918 B2 2/2007 Reinders et al.
7,231,967 B2 6/2007 Haglid
7,269,966 B2 9/2007 Lowenstein et al.
7,306,650 B2 12/2007 Slayzak et al.
7,331,376 B2 * 2/2008 Gagnon ..... F28D 21/0015 165/54
7,340,906 B2 3/2008 Moffitt
7,389,646 B2 6/2008 Moffitt
7,389,652 B1 6/2008 Fair
7,593,033 B2 9/2009 Walker et al.
7,602,414 B2 10/2009 Walker et al.
7,605,840 B2 10/2009 Walker et al.
7,717,404 B2 5/2010 Hasegawa et al.
7,719,565 B2 5/2010 Walker et al.
7,737,224 B2 6/2010 Willis et al.
7,753,991 B2 7/2010 Kertzman
7,781,034 B2 8/2010 Yializis et al.
7,817,182 B2 10/2010 Walker et al.
D638,925 S 5/2011 Charlebois et al.
7,942,387 B2 5/2011 Forkosh
7,966,841 B2 6/2011 Lowenstein et al.
8,002,023 B2 8/2011 Murayama
8,033,532 B2 10/2011 Yabu
8,137,436 B2 3/2012 Calis et al.
8,157,891 B2 4/2012 Montie et al.
8,318,824 B2 11/2012 Matsuoka et al.
8,511,074 B2 8/2013 Kuehnel et al.
8,550,151 B2 10/2013 Murayama et al.
8,769,971 B2 7/2014 Kozubal et al.
8,783,053 B2 7/2014 McCann
8,887,523 B2 11/2014 Gommed et al.
8,899,061 B2 12/2014 Reytblat
8,915,092 B2 12/2014 Gerber et al.
8,920,699 B2 12/2014 Marutani et al.
8,943,848 B2 2/2015 Phannavong et al.
8,966,924 B2 3/2015 Pichai
9,027,764 B2 5/2015 Murutani et al.
9,109,808 B2 8/2015 Gerber et al.
9,188,349 B2 11/2015 Warmerdam et al.
9,234,665 B2 1/2016 Erb et al.
9,243,810 B2 1/2016 Vandermeulen et al.
9,273,877 B2 3/2016 Vandermeulen
9,429,332 B2 8/2016 Vandermeulen et al.
9,429,366 B2 * 8/2016 Dubois ..... F28D 9/0062
9,664,452 B2 * 5/2017 Takada ..... F28D 21/0015
9,810,439 B2 11/2017 Coutu et al.
9,816,760 B2 11/2017 LePoudre et al.
9,909,768 B2 3/2018 Gerber et al.
10,197,310 B2 2/2019 Ghadiri Moghaddam et al.
10,302,317 B2 5/2019 Besant et al.
10,352,628 B2 7/2019 Erb et al.
10,480,801 B2 11/2019 Gerber et al.
10,584,884 B2 3/2020 Coutu et al.
10,712,024 B2 7/2020 LePoudre et al.
10,928,082 B2 2/2021 Coutu et al.
10,962,252 B2 3/2021 LePoudre et al.
11,035,618 B2 6/2021 Lepoudre et al.
2001/0003902 A1 6/2001 Kopko
2002/0005271 A1 1/2002 Weiss et al.
2002/0038552 A1 4/2002 Maisotsenko
2002/0074105 A1 6/2002 Hayashi et al.
2002/0158023 A1 10/2002 Wurzburger
2003/0014983 A1 1/2003 Maisotsenko et al.
2003/0037905 A1 2/2003 Weng
2003/0070787 A1 4/2003 Moffitt
2003/0121271 A1 7/2003 Dinnage et al.
2003/0132166 A1 7/2003 Rey
2004/0000152 A1 1/2004 Fischer
2004/0055329 A1 3/2004 Mathias et al.
2004/0061245 A1 4/2004 Maisotsenko et al.
2004/0134211 A1 7/2004 Lee et al.
2004/0134212 A1 7/2004 Lee et al.
2004/0168462 A1 9/2004 Assaf
2004/0226685 A1 11/2004 Gagnon et al.
2005/0056042 A1 3/2005 Bourne et al.
2005/0072303 A1 4/2005 Weidenmann
2005/0230080 A1 10/2005 Paul et al.
2005/0249901 A1 11/2005 Yializis et al.
2005/0262862 A1 12/2005 Moffitt
2005/0279115 A1 12/2005 Lee et al.
2006/0021615 A1 2/2006 Kertzman
2006/0042295 A1 3/2006 Assaf
2006/0205301 A1 9/2006 Klare et al.
2007/0029685 A1 2/2007 Lin
2007/0056894 A1 3/2007 Connors, Jr.
2007/0068663 A1 3/2007 Thomer et al.
2007/0095519 A1 5/2007 Hombucher
2007/0234743 A1 10/2007 Assaf
2007/0279861 A1 12/2007 Doll et al.
2008/0023182 A1 1/2008 Beamer et al.
2008/0066888 A1 3/2008 Tong et al.
2008/0085437 A1 4/2008 Dean et al.
2008/0099184 A1 5/2008 Han
2008/0283217 A1 11/2008 Gagnon et al.
2009/0071638 A1 * 3/2009 Murayama ..... F28F 3/025 165/166
2009/0095162 A1 4/2009 Hargis et al.
2009/0126913 A1 5/2009 Lee et al.
2009/0133866 A1 5/2009 Campbell et al.
2009/0193974 A1 8/2009 Montie et al.
2009/0211977 A1 8/2009 Miller
2009/0294110 A1 12/2009 Foust
2009/0324929 A1 12/2009 Yamakawa et al.
2010/0090356 A1 4/2010 Sines et al.
2010/0170655 A1 7/2010 Kronvall et al.
2010/0170776 A1 7/2010 Ehrenberg et al.
2010/0181062 A1 7/2010 Mccann
2010/0192605 A1 8/2010 Fang et al.
2010/0200068 A1 8/2010 D'arcy et al.
2010/0275629 A1 11/2010 Erickson
2010/0300123 A1 12/2010 Park et al.
2010/0319370 A1 12/2010 Kozubal et al.
2010/0326914 A1 12/2010 Drost et al.
2011/0056384 A1 3/2011 Kadota
2011/0192579 A1 8/2011 Sotokawa et al.
2011/0223486 A1 9/2011 Zhang et al.
2011/0232485 A1 9/2011 Ellsworth
2011/0232633 A1 9/2011 Lima
2011/0259572 A1 * 10/2011 Muratani ..... B29C 45/14631 165/185
2011/0308265 A1 12/2011 Phannavong et al.
2012/0000227 A1 1/2012 Matsuura et al.
2012/0031133 A1 2/2012 Kuwabara et al.
2012/0061045 A1 3/2012 Huizing
2012/0073791 A1 3/2012 Dubois
2012/0085112 A1 4/2012 Wintemute
2012/0106073 A1 5/2012 Wu et al.
2012/0125020 A1 5/2012 Vandermeulen et al.
2012/0125021 A1 5/2012 Vandermeulen et al.
2012/0125023 A1 5/2012 Kopko et al.
2012/0125031 A1 5/2012 Vandermeulen et al.
2012/0125405 A1 5/2012 Vandermeulen et al.
2012/0125581 A1 5/2012 Allen et al.
2012/0131934 A1 5/2012 Vandermeulen et al.
2012/0131937 A1 5/2012 Vandermeulen et al.
2012/0131938 A1 5/2012 Vandermeulen et al.

(56) References Cited

U.S. PATENT DOCUMENTS

| | | | |
|---|---|---|---|
| 2012/0131939 | A1 | 5/2012 | Vandermeulen et al. |
| 2012/0131940 | A1 | 5/2012 | Vandermeulen et al. |
| 2012/0132513 | A1 | 5/2012 | Vandermeulen et al. |
| 2012/0162918 | A1 | 6/2012 | Thyni et al. |
| 2012/0016700 | A1 | 7/2012 | Dunnavant |
| 2012/0167600 | A1 | 7/2012 | Dunnavant |
| 2012/0168369 | A1* | 7/2012 | Van Medevoort ..... B29C 45/0053 210/335 |
| 2012/0180505 | A1 | 7/2012 | Gerber et al. |
| 2012/0186281 | A1 | 7/2012 | Vandermeulen et al. |
| 2012/0247132 | A1 | 10/2012 | Lakdawala et al. |
| 2012/0298340 | A1 | 11/2012 | Al-Otaibi |
| 2013/0029148 | A1 | 3/2013 | Hemingson et al. |
| 2013/0056177 | A1 | 3/2013 | Coutu et al. |
| 2013/0186121 | A1 | 7/2013 | Erb et al. |
| 2013/0199220 | A1 | 8/2013 | Ma et al. |
| 2013/0240438 | A1 | 9/2013 | Willis et al. |
| 2013/0248147 | A1 | 9/2013 | Wintemute et al. |
| 2013/0283837 | A1 | 10/2013 | Takahashi et al. |
| 2013/0340449 | A1 | 12/2013 | Kozubal et al. |
| 2014/0054004 | A1 | 2/2014 | LePoudre et al. |
| 2014/0054013 | A1 | 2/2014 | Lepoudre et al. |
| 2014/0083648 | A1 | 3/2014 | Wawryk |
| 2014/0190037 | A1 | 7/2014 | Erb et al. |
| 2014/0242900 | A1* | 8/2014 | Takada ..... F24F 13/02 454/284 |
| 2014/0138851 | A1 | 9/2014 | LePoudre |
| 2014/0245769 | A1 | 9/2014 | Vandermeulen et al. |
| 2014/0260367 | A1 | 9/2014 | Coutu et al. |
| 2014/0260369 | A1 | 9/2014 | Lepoudre et al. |
| 2014/0260373 | A1 | 9/2014 | Gerber et al. |
| 2014/0260399 | A1 | 9/2014 | Vandermeulen |
| 2014/0262125 | A1 | 9/2014 | Erb et al. |
| 2014/0262144 | A1 | 9/2014 | Erb et al. |
| 2014/0326433 | A1 | 11/2014 | Kozubal |
| 2015/0096714 | A1 | 4/2015 | Dagley |
| 2015/0184876 | A1 | 7/2015 | Vandermeulen et al. |
| 2015/0292754 | A1 | 10/2015 | Mongar |
| 2015/0323203 | A1 | 11/2015 | Gerber et al. |
| 2016/0054012 | A1 | 2/2016 | Lepoudre et al. |
| 2016/0084512 | A1 | 3/2016 | Erb et al. |
| 2016/0018701 | A1 | 6/2016 | Vandermeulen |
| 2016/0290666 | A1 | 10/2016 | Coutu et al. |
| 2016/0298865 | A1 | 10/2016 | Gerber et al. |
| 2016/0327345 | A1 | 11/2016 | Lowenstein |
| 2017/0241655 | A1 | 8/2017 | Lepoudre et al. |
| 2018/0073753 | A1 | 3/2018 | Lepoudre et al. |
| 2018/0012851 | A1 | 5/2018 | Lepoudre et al. |
| 2018/0135880 | A1 | 5/2018 | Ghadiri Moghaddam et al. |
| 2018/0187918 | A1 | 7/2018 | Lepoudre et al. |
| 2019/0113247 | A1 | 4/2019 | Lepoudre et al. |
| 2019/0212020 | A1 | 7/2019 | Besant et al. |
| 2020/0173672 | A1 | 6/2020 | Coutu et al. |
| 2021/0231384 | A1 | 7/2021 | Lepoudre et al. |
| 2021/0332993 | A1 | 10/2021 | Coutu et al. |

FOREIGN PATENT DOCUMENTS

| | | | |
|---|---|---|---|
| AU | 2014231672 | B2 | 3/2018 |
| AU | 2015230799 | B2 | 3/2018 |
| AU | 2013305427 | B2 | 4/2018 |
| AU | 2014231681 | B2 | 6/2018 |
| AU | 2013305428 | B2 | 9/2018 |
| AU | 2014231668 | B2 | 2/2019 |
| AU | 2014231667 | B2 | 6/2019 |
| AU | 2017204552 | B2 | 7/2019 |
| AU | 2018236791 | B2 | 10/2020 |
| AU | 2018204774 | B2 | 11/2020 |
| CA | 2283089 | A1 | 11/2000 |
| CA | 2801352 | A1 | 12/2011 |
| CA | 2798928 | A1 | 2/2012 |
| CA | 2843763 | A1 | 3/2013 |
| CA | 2904224 | A1 | 9/2014 |
| CA | 2901483 | C | 4/2019 |
| CA | 2880353 | C | 9/2020 |
| CA | 3034592 | C | 2/2021 |
| CH | 193732 | A | 10/1937 |
| CN | 1163389 | A | 10/1997 |
| CN | 1343292 | A | 4/2002 |
| CN | 1456855 | A | 11/2003 |
| CN | 1517610 | A | 8/2004 |
| CN | 1518477 | A | 8/2004 |
| CN | 1666081 | A | 9/2005 |
| CN | 1711448 | A | 12/2005 |
| CN | 2821506 | Y | 9/2006 |
| CN | 200958820 | Y | 10/2007 |
| CN | 101368754 | A | 2/2009 |
| CN | 201203217 | Y | 3/2009 |
| CN | 101405559 | A | 4/2009 |
| CN | 101421580 | A | 4/2009 |
| CN | 101469090 | A | 7/2009 |
| CN | 101776406 | A | 7/2010 |
| CN | 101900385 | A | 12/2010 |
| CN | 101918777 | A | 12/2010 |
| CN | 102076401 | A | 5/2011 |
| CN | 201906567 | U | 7/2011 |
| CN | 102149979 | A | 8/2011 |
| CN | 102165268 | A | 8/2011 |
| CN | 102232015 | A | 11/2011 |
| CN | 102345909 | A | 2/2012 |
| CN | 102395419 | A | 3/2012 |
| CN | 202202899 | U | 4/2012 |
| CN | 102548727 | A | 7/2012 |
| CN | 102549361 | A | 7/2012 |
| CN | 102713154 | A | 10/2012 |
| CN | 102933931 | A | 2/2013 |
| CN | 102939397 | A | 2/2013 |
| CN | 103068246 | A | 4/2013 |
| CN | 103069246 | A | 4/2013 |
| CN | 103245018 | A | 8/2013 |
| CN | 203116208 | U | 8/2013 |
| CN | 103827595 | A | 5/2014 |
| CN | 104048434 | A | 9/2014 |
| CN | 203893703 | U | 10/2014 |
| CN | 104136855 | A | 11/2014 |
| CN | 104583706 | A | 4/2015 |
| CN | 103261801 | B | 11/2015 |
| CN | 105121989 | A | 12/2015 |
| CN | 105164474 | A | 12/2015 |
| CN | 105164484 | A | 12/2015 |
| CN | 105202795 | A | 12/2015 |
| CN | 105283715 | A | 1/2016 |
| CN | 101512238 | A | 8/2016 |
| CN | 103827595 | B | 4/2017 |
| CN | 105164484 | B | 6/2017 |
| CN | 105121989 | B | 9/2017 |
| CN | 107249715 | A | 10/2017 |
| CN | 107300230 | A | 10/2017 |
| CN | 107560482 | A | 1/2018 |
| CN | 107850335 | A | 3/2018 |
| CN | 107923647 | A | 4/2018 |
| CN | 108027221 | A | 5/2018 |
| CN | 109028519 | A | 12/2018 |
| CN | 109073265 | A | 12/2018 |
| CN | 110345803 | A | 10/2019 |
| CN | 107300230 | B | 11/2019 |
| CN | 107560482 | B | 2/2020 |
| CN | 107249715 | B | 11/2020 |
| CN | 107850335 | B | 2/2021 |
| CN | 108027221 | B | 3/2021 |
| DE | 10143092 | A1 | 3/2003 |
| EP | 0448991 | A2 | 10/1991 |
| EP | 0661502 | A2 | 7/1995 |
| EP | 0678321 | A2 | 10/1995 |
| EP | 1108575 | A1 | 6/2001 |
| EP | 1347260 | A1 | 9/2003 |
| EP | 2351639 | A1 | 8/2011 |
| EP | 2397787 | A2 | 12/2011 |
| EP | 2751493 | B1 | 3/2018 |
| EP | 3314188 | A1 | 5/2018 |
| EP | 2893283 | B1 | 12/2018 |
| EP | 2972039 | B1 | 12/2018 |

(56) References Cited

FOREIGN PATENT DOCUMENTS

| | | | |
|---|---|---|---|
| EP | 2971993 | B1 | 8/2019 |
| EP | 2971992 | B1 | 1/2020 |
| EP | 3421921 | B1 | 3/2020 |
| EP | 3183051 | B1 | 4/2020 |
| EP | 3486577 | B1 | 4/2020 |
| EP | 2972046 | B1 | 6/2020 |
| EP | 3499168 | B1 | 2/2021 |
| EP | 3314188 | B1 | 5/2021 |
| FR | 2291457 | A1 | 6/1976 |
| GB | 1354502 | A | 6/1974 |
| GB | 2015384 | A | 9/1979 |
| HK | 40009311 | A1 | 6/2020 |
| IN | 201717044889 | A | 3/2018 |
| IN | 201717044890 | A | 3/2018 |
| IN | 201817002765 | A | 4/2018 |
| IN | 201817037404 | A | 12/2018 |
| JP | 6152594 | A | 3/1986 |
| JP | 05157282 | A | 6/1993 |
| JP | H09113167 | A | 5/1997 |
| JP | 09196482 | A | 7/1997 |
| JP | 10170177 | A | 6/1998 |
| JP | 2004116419 | A | 4/2004 |
| JP | 2004257588 | A | 9/2004 |
| JP | 2008070046 | A | 3/2008 |
| JP | 2009275955 | A | 11/2009 |
| JP | 4870843 | B1 | 11/2011 |
| KR | 100607204 | B1 | 8/2006 |
| KR | 20110092773 | A | 8/2011 |
| SG | 10201809840 | | 12/2018 |
| SG | 11201807692 | | 2/2020 |
| SG | 10201913923 | | 3/2020 |
| TW | I271499 | B | 1/2007 |
| WO | WO-9641107 | A1 | 12/1996 |
| WO | WO-1996041107 | A1 | 12/1996 |
| WO | WO-1999014535 | A1 | 3/1999 |
| WO | WO-0135039 | A1 | 5/2001 |
| WO | WO-0171260 | A1 | 9/2001 |
| WO | WO-0201132 | A2 | 1/2002 |
| WO | WO-03049835 | A1 | 6/2003 |
| WO | WO-2004065875 | A1 | 8/2004 |
| WO | WO-2005100243 | A1 | 10/2005 |
| WO | WO-2008037079 | A1 | 4/2008 |
| WO | WO-2008053367 | A2 | 5/2008 |
| WO | WO-2008089484 | A1 | 7/2008 |
| WO | WO-2009000974 | A1 | 12/2008 |
| WO | WO-2009094032 | A1 | 7/2009 |
| WO | WO-2009158030 | A1 | 12/2009 |
| WO | WO-2010006968 | A1 | 1/2010 |
| WO | WO-2011062808 | A1 | 5/2011 |
| WO | WO-2011150081 | A2 | 12/2011 |
| WO | WO-2011161547 | A2 | 12/2011 |
| WO | WO-2011161547 | A3 | 12/2011 |
| WO | WO-2012018089 | A1 | 2/2012 |
| WO | WO-2012042553 | A1 | 4/2012 |
| WO | WO-2012050860 | A1 | 4/2012 |
| WO | WO-2012087273 | A1 | 6/2012 |
| WO | WO-2012097445 | A1 | 7/2012 |
| WO | WO-2012167366 | A1 | 12/2012 |
| WO | WO-2013029148 | A1 | 3/2013 |
| WO | WO-2013094206 | A1 | 6/2013 |
| WO | WO-2013107554 | A1 | 7/2013 |
| WO | WO-2013192397 | A1 | 12/2013 |
| WO | WO-2014029003 | A1 | 2/2014 |
| WO | WO-2014029004 | A1 | 2/2014 |
| WO | WO-2014107790 | A1 | 7/2014 |
| WO | WO-2014138846 | A1 | 9/2014 |
| WO | WO-2014138847 | A1 | 9/2014 |
| WO | WO-2014138851 | A1 | 9/2014 |
| WO | WO-2014138859 | A1 | 9/2014 |
| WO | WO-2014138860 | A1 | 9/2014 |
| WO | WO-2014142277 | A1 | 9/2014 |
| WO | WO-2015192249 | A1 | 12/2015 |
| WO | WO-2016026042 | A1 | 2/2016 |
| WO | WO-2016183667 | A1 | 11/2016 |
| WO | WO-2016183668 | A1 | 11/2016 |
| WO | WO-2016207864 | A1 | 12/2016 |
| WO | WO-2017152268 | A1 | 9/2017 |

OTHER PUBLICATIONS

"Advances in Desiccant-Based Dehumidification", American Standard, TRANE Engineers Newsletter, vol. 34-4, (2005), 8 pgs.

"U.S. Appl. No. 14/190,715, Response filed Jul. 20, 2018 to Final Office Action dated Feb. 20, 2018", 14 pgs.

"U.S. Appl. No. 10/048,797, Amendment and Response filed Apr. 29, 2003 to Non-Final Office dated Mar. 11, 2003", 10 pgs.

"U.S. Appl. No. 10/048,797, Non-Final Office dated Mar. 11, 2003", 4 pgs.

"U.S. Appl. No. 10/048,797, Notice of Allowance dated May 13, 2003", 5 pgs.

"U.S. Appl. No. 13/350,902, Appeal Brief filed Apr. 4, 2014", 24 pgs.

"U.S. Appl. No. 13/350,902, Appeal Decision mailed Sep. 30, 2016", 6 pgs.

"U.S. Appl. No. 13/350,902, Examiner's Answer dated Jun. 16, 2014", 17 pgs.

"U.S. Appl. No. 13/350,902, Final Office Action dated Dec. 30, 2013", 13 pgs.

"U.S. Appl. No. 13/350,902, Non Final Office Action dated Oct. 1, 2013", 13 pgs.

"U.S. Appl. No. 13/350,902, Notice of Allowance dated Mar. 1, 2017", 7 pgs.

"U.S. Appl. No. 13/350,902, Notice of Allowance dated Nov. 9, 2016", 9 pgs.

"U.S. Appl. No. 13/350,902, Reply Brief filed Jul. 8, 2014", 9 pgs.

"U.S. Appl. No. 13/350,902, Response filed Aug. 5, 2013 to Restriction Requirement dated Jul. 23, 2013", 2 pgs.

"U.S. Appl. No. 13/350,902, Response filed Oct. 29, 2013 to Non Final Office Action dated Oct. 1, 2013", 15 pgs.

"U.S. Appl. No. 13/350,902, Restriction Requirement dated Jul. 23, 2013", 8 pgs.

"U.S. Appl. No. 13/449,598, Final Office Action dated Feb. 4, 2016", 23 pgs.

"U.S. Appl. No. 13/449,598, Non Final Office Action dated Apr. 24, 2015", 18 pgs.

"U.S. Appl. No. 13/449,598, Non Final Office Action dated Aug. 27, 2015", 20 pgs.

"U.S. Appl. No. 13/449,598, Notice of Allowance dated Mar. 10, 2017", 7 pgs.

"U.S. Appl. No. 13/449,598, Notice of Allowance dated Jul. 6, 2017", 7 pgs.

"U.S. Appl. No. 13/449,598, Notice of Allowance dated Nov. 4, 2016", 9 pgs.

"U.S. Appl. No. 13/449,598, Response filed Jan. 29, 2015 to Restriction Requirement dated Jan. 5, 2015", 2 pgs.

"U.S. Appl. No. 13/449,598, Response filed Jul. 17, 2015 to Non Final Office Action dated Apr. 24, 2015", 17 pgs.

"U.S. Appl. No. 13/449,598, Response filed Nov. 16, 2015 to Non Final Office Action dated Aug. 27, 2015", 18 pgs.

"U.S. Appl. No. 13/449,598, Restriction Requirement dated Jan. 5, 2015", 10 pgs.

"U.S. Appl. No. 13/702,596, Appeal Brief filed Jun. 15, 2015", 82 pgs.

"U.S. Appl. No. 13/702,596, Final Office Action dated Jan. 30, 2015", 15 pgs.

"U.S. Appl. No. 13/702,596, Non Final Office Action dated Oct. 30, 2014", 16 pgs.

"U.S. Appl. No. 13/702,596, Notice of Allowance dated Oct. 1, 2015", 7 pgs.

"U.S. Appl. No. 13/702,596, Notice of Allowance dated Nov. 25, 2015", 2 pgs.

"U.S. Appl. No. 13/702,596, Post Allowance Amendment filed Oct. 7, 2015", 13 pgs.

"U.S. Appl. No. 13/702,596, PTO Response to Rule 312 Communication dated Oct. 19, 2015", 2 pgs.

(56) References Cited

OTHER PUBLICATIONS

"U.S. Appl. No. 13/702,596, Response filed Dec. 15, 2014 to Non Final Office Action dated Oct. 30, 2014", 21 pgs.
"U.S. Appl. No. 13/797,062, Amendment and Response Under 37 C.F.R. 1.116 filed Jan. 22, 2018 to Final Office Action dated Feb. 24, 2016", 11 pgs.
"U.S. Appl. No. 13/797,062, Appeal Brief filed Jun. 9, 2016", 33 pgs.
"U.S. Appl. No. 13/797,062, Appeal Decision dated Nov. 22, 2017", 15 pgs.
"U.S. Appl. No. 13/797,062, Final Office Action dated Feb. 24, 2016", 29 pgs.
"U.S. Appl. No. 13/797,062, Final Office Action dated Jul. 13, 2018", 22 pgs.
"U.S. Appl. No. 13/797,062, Non Final Office Action dated Feb. 21, 2018", 21 pgs.
"U.S. Appl. No. 13/797,062, Non Final Office Action dated May 7, 2015", 19 pgs.
"U.S. Appl. No. 13/797,062, Non Final Office Action dated Sep. 25, 2015", 24 pgs.
"U.S. Appl. No. 13/797,062, Response filed Apr. 23, 2015 to Restriction Requirement dated Mar. 13, 2015", 3 pgs.
"U.S. Appl. No. 13/797,062, Response filed Jul. 17, 2015 to Non Final Office Action dated May 7, 2015", 16 pgs.
"U.S. Appl. No. 13/797,062, Response filed Nov. 30, 2015 to Non Final Office Action dated Sep. 25, 2015", 16 pgs.
"U.S. Appl. No. 13/797,062, Response filed May 21, 2018 to Non Final Office Action dated Feb. 21, 2018", 12 pgs.
"U.S. Appl. No. 13/797,062, Restriction Requirement dated Mar. 13, 2015", 8 pgs.
"U.S. Appl. No. 13/797,152, Appeal Brief filed Jun. 9, 2016", 29 pgs.
"U.S. Appl. No. 13/797,152, Corrected Notice of Allowance dated Mar. 9, 2017", 7 pgs.
"U.S. Appl. No. 13/797,152, Final Office Action dated Feb. 25, 2016", 14 pgs.
"U.S. Appl. No. 13/797,152, Non Final Office Action dated Aug. 25, 2015", 10 pgs.
"U.S. Appl. No. 13/797,152, Notice of Allowance dated Mar. 9, 2017", 7 pgs.
"U.S. Appl. No. 13/797,152, Notice of Allowance dated Jun. 27, 2017", 8 pgs.
"U.S. Appl. No. 13/797,152, Notice of Allowance dated Oct. 31, 2016", 7 pgs.
"U.S. Appl. No. 13/797,152, Response filed Nov. 20, 2015 to Non Final Office Action dated Aug. 25, 2015", 12 pgs.
"U.S. Appl. No. 13/801,280, 312 Amendment filed Jun. 18, 2015", 8 pgs.
"U.S. Appl. No. 13/801,280, Non Final Office Action dated Feb. 12, 2015", 7 pgs.
"U.S. Appl. No. 13/801,280, Notice of Allowance dated May 19, 2015", 7 pgs.
"U.S. Appl. No. 13/801,280, PTO Response to 312 Amendment dated Jul. 9, 2015", 2 pgs.
"U.S. Appl. No. 13/801,280, Response filed Jan. 7, 2015 to Restriction Requirement dated Dec. 10, 2014", 1 pg.
"U.S. Appl. No. 13/801,280, Response filed Mar. 31, 2015 to Non Final Office Action dated Feb. 12, 2015", 9 pgs.
"U.S. Appl. No. 13/801,280, Restriction Requirement dated Dec. 10, 2014", 9 pgs.
"U.S. Appl. No. 14/171,951, Advisory Action dated Nov. 10, 2016", 3 pgs.
"U.S. Appl. No. 14/171,951, Final Office Action dated Jun. 28, 2016", 36 pgs.
"U.S. Appl. No. 14/171,951, Non Final Office Action dated Jan. 5, 2016", 20 pgs.
"U.S. Appl. No. 14/171,951, Non Final Office Action dated May 2, 2016", 35 pgs.
"U.S. Appl. No. 14/171,951, Notice of Allowability dated Jul. 18, 2018", 2 pgs.
"U.S. Appl. No. 14/171,951, Notice of Allowance dated Jan. 19, 2018", 5 pgs.
"U.S. Appl. No. 14/171,951, Notice of Allowance dated Feb. 3, 2017", 5 pgs.
"U.S. Appl. No. 14/171,951, Notice of Allowance dated May 23, 2018", 5 pgs.
"U.S. Appl. No. 14/171,951, Notice of Allowance dated Jun. 8, 2017", 5 pgs.
"U.S. Appl. No. 14/171,951, Notice of Allowance dated Oct. 3, 2017", 5 pgs.
"U.S. Appl. No. 14/171,951, Response filed Mar. 28, 2016 to Non Final Office Action dated Jan. 5, 2016", 18 pgs.
"U.S. Appl. No. 14/171,951, Response filed Jun. 9, 2016 to Non Final Office Action dated May 2, 2016", 24 pgs.
"U.S. Appl. No. 14/171,951, Response filed Oct. 28, 2016 to Final Office Action dated Jun. 28, 2016", 15 pgs.
"U.S. Appl. No. 14/171,951, Response filed Dec. 3, 2015 to Restriction Requirement dated Nov. 16, 2015", 6 pgs.
"U.S. Appl. No. 14/171,951, Response filed Dec. 15, 2016 to Advisory Action dated Nov. 10, 2016", 16 pgs.
"U.S. Appl. No. 14/171,951, Restriction Requirement dated Nov. 16, 2015", 13 pgs.
"U.S. Appl. No. 14/186,420, Notice of Allowance dated Jan. 27, 2017", 7 pgs.
"U.S. Appl. No. 14/187,413, Advisory Action dated Nov. 10, 2016", 4 pgs.
"U.S. Appl. No. 14/187,413, Final Office Action dated Jun. 27, 2017", 16 pgs.
"U.S. Appl. No. 14/187,413, Final Office Action dated Jul. 26, 2018", 16 pgs.
"U.S. Appl. No. 14/187,413, Final Office Action dated Jul. 28, 2016", 20 pgs.
"U.S. Appl. No. 14/187,413, Non Final Office Action dated Feb. 8, 2017", 15 pgs.
"U.S. Appl. No. 14/187,413, Non Final Office Action dated Mar. 17, 2016", 15 pgs.
"U.S. Appl. No. 14/187,413, Non Final Office Action dated Dec. 18, 2017", 20 pgs.
"U.S. Appl. No. 14/187,413, Response filed Feb. 25, 2015 to Restriction Requirement dated Feb. 16, 2016", 3 pgs.
"U.S. Appl. No. 14/187,413, Response filed May 26, 2016 to Non Final Office Action dated Mar. 17, 2016", 15 pgs.
"U.S. Appl. No. 14/187,413, Response filed Jun. 8, 2017 to Non Final Office Action dated Feb. 8, 2017", 15 pgs.
"U.S. Appl. No. 14/187,413, Response filed Oct. 28, 2016 to Final Office Action dated Jul. 28, 2016", 17 pgs.
"U.S. Appl. No. 14/187,413, Response filed Nov. 27, 2017 to Final Office Action dated Jun. 27, 2017", 14 pgs.
"U.S. Appl. No. 14/187,413, Response filed Dec. 21, 2016 to Final Office Action dated Jul. 28, 2016 and Advisory Action dated Nov. 10, 2016", 15 pgs.
"U.S. Appl. No. 14/187,413, Restriction Requirement dated Feb. 16, 2016", 6 pgs.
"U.S. Appl. No. 14/190,715, Advisory Action dated Aug. 16, 2018", 6 pgs.
"U.S. Appl. No. 14/190,715, Examiner Interview Summary dated Oct. 31, 2018", 3 pgs.
"U.S. Appl. No. 14/190,715, Final Office Action dated Feb. 20, 2018", 9 pgs.
"U.S. Appl. No. 14/190,715, Non Final Office Action dated Aug. 10, 2017", 9 pgs.
"U.S. Appl. No. 14/190,715, Notice of Allowance dated Mar. 4, 2019", 7 pgs.
"U.S. Appl. No. 14/190,715, Response filed Jul. 12, 2017 to Restriction Requirement dated Apr. 12, 2017", 7 pgs.
"U.S. Appl. No. 14/190,715, Response filed Nov. 9, 2017 to Non Final Office Action dated Aug. 10, 2017", 10 pgs.
"U.S. Appl. No. 14/190,715, Restriction Requirement dated Apr. 13, 2017", 7 pgs.
"U.S. Appl. No. 14/192,019, Final Office Action dated Nov. 28, 2017", 16 pgs.
"U.S. Appl. No. 14/192,019, Non Final Office Action dated May 11, 2018", 16 pgs.

(56) References Cited

OTHER PUBLICATIONS

"U.S. Appl. No. 14/192,019, Non Final Office Action dated May 19, 2017", 15 pgs.
"U.S. Appl. No. 14/192,019, Response filed Aug. 21, 2017 to Non Final Office Action dated May 19, 2017", 13 pgs.
"U.S. Appl. No. 14/192,019, Response filed Apr. 27, 2018 to Final Office Action dated Nov. 28, 2017", 11 pgs.
"U.S. Appl. No. 14/804,953, Corrected Notice of Allowance dated Jan. 25, 2018", 4 pgs.
"U.S. Appl. No. 14/804,953, Non Final Office Action dated Sep. 15, 2016", 8 pgs.
"U.S. Appl. No. 14/804,953, Notice of Allowance dated Feb. 27, 2017", 7 pgs.
"U.S. Appl. No. 14/804,953, Notice of Allowance dated May 9, 2017", 7 pgs.
"U.S. Appl. No. 14/804,953, Notice of Allowance dated Sep. 7, 2017", 7 pgs.
"U.S. Appl. No. 14/804,953, Response filed Dec. 15, 2016 to Non Final Office Action dated Sep. 15, 2016", 7 pgs.
"U.S. Appl. No. 14/830,492, Non-Final Action dated Mar. 15, 2018", 9 pgs.
"U.S. Appl. No. 14/830,492, Response filed Feb. 15, 2018 to Restriction Requirement dated Dec. 15, 2017", 7 pgs.
"U.S. Appl. No. 14/830,492, Restriction Requirement dated Dec. 15, 2017", 6 pgs.
"U.S. Appl. No. 14/957,795, Corrected Notice of Allowance dated May 16, 2018", 4 pgs.
"U.S. Appl. No. 14/957,795, Final Office Action dated Nov. 6, 2017", 17 pgs.
"U.S. Appl. No. 14/957,795, Non Final Office Action dated Apr. 3, 2017", 19 pgs.
"U.S. Appl. No. 14/957,795, Notice of Allowance dated Apr. 27, 2018", 8 pgs.
"U.S. Appl. No. 14/957,795, Response filed Apr. 3, 2018 to Final Office Action dated Nov. 6, 2017", 11 pgs.
"U.S. Appl. No. 14/957,795, Response filed Aug. 3, 2017 to Non Final Office Action dated Apr. 3, 2017", 17 pgs.
"U.S. Appl. No. 15/185,155, Non Final Office Action dated Apr. 10, 2018", 13 pgs.
"U.S. Appl. No. 15/185,155, Response filed Aug. 6, 2018 to Non Final Office Action dated Apr. 10, 2018", 10 pgs.
"U.S. Appl. No. 15/185,180, Restriction Requirement dated Jun. 21, 2018", 10 pgs.
"U.S. Appl. No. 15/590,685, Final Office Action dated Jun. 7, 2018", 12 pgs.
"U.S. Appl. No. 15/590,685, Non Final Office Action dated Oct. 6, 2017", 11 pgs.
"U.S. Appl. No. 15/590,685, Response filed Feb. 20, 2018 to Non Final Office Action dated Oct. 6, 2017", 7 pgs.
"Australian Application Serial No. 2011268661, First Examiner Report dated Sep. 24, 2014", 5 pgs.
"Australian Application Serial No. 2011268661, Response filed Jul. 20, 2015 to First Examiner Report dated Sep. 24, 2014", 8 pgs.
"Australian Application Serial No. 2011268661, Response filed Sep. 23, 2015 to Second Examiner Report dated Aug. 18, 2015", 5 pgs.
"Australian Application Serial No. 2011268661, Second Examiner Report dated Aug. 18, 2015", 6 pgs.
"Australian Application Serial No. 2012208921, First Examiner Report dated Jun. 2, 2016", 7 pgs.
"Australian Application Serial No. 2012304223, First Examiner Report dated Aug. 5, 2016", 4 pgs.
"Australian Application Serial No. 2012304223, Response filed Feb. 16, 2017 to First Examiner Report dated Aug. 5, 2016", 25 pgs.
"Australian Application Serial No. 2013305427, Examination Report dated Mar. 3, 2017", 4 pgs.
"Australian Application Serial No. 2013305427, Response filed Oct. 10, 2017 to Examination Report dated Mar. 3, 2017", 30 pgs.
"Australian Application Serial No. 2013305428, Office Action dated May 30, 2017", 5 pgs.
"Australian Application Serial No. 2013305428, Response filed May 15, 2018 to Office Action dated May 30, 2017", 23 pgs.
"Australian Application Serial No. 2014231667, First Examination Report dated Apr. 5, 2018", 4 pgs.
"Australian Application Serial No. 2014231667, Response filed Jul. 20, 2018 to First Examination Report dated Apr. 5, 2018", 19 pgs.
"Australian Application Serial No. 2014231668, First Examination Report dated Dec. 6, 2017", 6 pgs.
"Australian Application Serial No. 2014231668, Response filed Mar. 14, 2018 to First Examination Report dated Dec. 6, 2017", 31 pgs.
"Australian Application Serial No. 2014231668, Subsequent Examiners Report dated Apr. 5, 2018", 3 pgs.
"Australian Application Serial No. 2014231672, First Examiners Report dated Jul. 14, 2017", 4 pgs.
"Australian Application Serial No. 2014231672, Response filed Oct. 9, 2017 to First Examiners Report dated Jul. 14, 2017", 24 pgs.
"Australian Application Serial No. 2014231680, First Examiners Report dated Aug. 4, 2017", 4 pgs.
"Australian Application Serial No. 2014231681, First Examiners Report dated Jul. 12, 2017", 4 pgs.
"Australian Application Serial No. 2014231681, Response filed Jan. 30, 2018 to Subsequent Examiners Report dated Sep. 26, 2017", 15 pgs.
"Australian Application Serial No. 2014231681, Response filed Apr. 26, 2018 to Subsequent Examiners Report dated Mar. 13, 2018", 3 pgs.
"Australian Application Serial No. 2014231681, Response filed Sep. 15, 2017 to First Examiners Report dated Jul. 12, 2017", 9 pgs.
"Australian Application Serial No. 2014231681, Subsequent Examiners Report dated Mar. 13, 2018", 4 pgs.
"Australian Application Serial No. 2014231681, Subsequent Examiners Report dated Sep. 26, 2017", 4 pgs.
"Australian Application Serial No. 2015230799, First Examiner Report dated Mar. 27, 2017", 10 pgs.
"Australian Application Serial No. 2015230799, Response filed Feb. 16, 2018 to First Examiner Report dated Mar. 27, 2017", 24 pgs.
"Canadian Application Serial No. 2,801,352, Office Action dated Jul. 4, 2017", 3 pgs.
"Canadian Application Serial No. 2,801,352, Office Action dated Aug. 2, 2018", 3 pgs.
"Canadian Application Serial No. 2,801,352, Office Action dated Aug. 15, 2016", 3 pgs.
"Canadian Application Serial No. 2,801,352, Response filed Feb. 8, 2017 to Office Action dated Aug. 15, 2016", 89 pgs.
"Canadian Application Serial No. 2,801,352, Response filed Dec. 18, 2017 to Office Action dated Jul. 4, 2017", 8 pgs.
"Canadian Application Serial No. 2,843,763, Office Action dated Dec. 4, 2014", 3 pgs.
"Canadian Application Serial No. 2,843,763, Response filed May 12, 2015 to Office Action dated Dec. 4, 2014", 31 pgs.
"Canadian Application Serial No. 2,901,483, Office Action dated Jul. 19, 2017", 3 pgs.
"Canadian Application Serial No. 2,901,483, Office Action dated Nov. 23, 2016", 4 pgs.
"Canadian Application Serial No. 2,901,483, Response filed Jan. 16, 2018 to Office Action dated Jul. 19, 2017", 28 pgs.
"Canadian Application Serial No. 2,901,483, Response filed May 23, 2017 to Office Action dated Nov. 23, 2016", 40 pgs.
"Chapter 8—Heating, Ventilating, and Air Conditioning (HVAC) Demonstration", HVAC Demonstration, (published prior to Feb. 21, 2014), 16 pgs.
"Chinese Application Serial No. 201280006006.9, Office Action dated Feb. 2, 2016", w/ English Summary, 19 pgs.
"Chinese Application Serial No. 201280006006.9, Response filed Apr. 8, 2016 to Office Action dated Feb. 2, 2016", w/ English Translation of Claims, 64 pgs.
"Chinese Application Serial No. 201280006006.9, Voluntary Amendment filed Apr. 14, 2014", w/ English Claims, 83 pgs.
"Chinese Application Serial No. 201180031103.9, Office Action dated Feb. 11, 2015", w/ English Translation, 16 pgs.

(56) References Cited

OTHER PUBLICATIONS

"Chinese Application Serial No. 201180031103.9, Office Action dated Jun. 13, 2014", w/ English Translation, 19 pgs.
"Chinese Application Serial No. 201180031103.9, Office Action dated Sep. 9, 2015", w/ English Translation, 7 pgs.
"Chinese Application Serial No. 201180031103.9, Office Action dated Nov. 6, 2015", w/ English Translation, 5 pgs.
"Chinese Application Serial No. 201180031103.9, Response filed Apr. 27, 2015 to Office Action dated Feb. 11, 2015", w/ English Translation, 15 pgs.
"Chinese Application Serial No. 201180031103.9, Response filed Sep. 26, 2014 to Office Action dated Jun. 13, 2014", w/ English Translation, 12 pgs.
"Chinese Application Serial No. 201180031103.9, Response filed Sep. 29, 2015 to Office Action dated Sep. 9, 2015", w/ English Translation, 78 pgs.
"Chinese Application Serial No. 201280006006.9, Office Action dated May 13, 2015", w/ English Translation, 7 pgs.
"Chinese Application Serial No. 201280006006.9, Office Action dated Aug. 15, 2016", w/ English Translation, 18 pgs.
"Chinese Application Serial No. 201280006006.9, Response filed Sep. 28, 2015 to Office Action dated May 13, 2015", w/ English Claims, 71 pgs.
"Chinese Application Serial No. 201280006006.9, Response filed Dec. 30, 2016 to Office Action dated Aug. 15, 2016", w/ English Claims, 69 pgs.
"Chinese Application Serial No. 201280042778.8, Office Action dated Feb. 3, 2016", w/ English Translation, 9 pgs.
"Chinese Application Serial No. 201280042778.8, Office Action dated Sep. 7, 2016", w/ English Claims, 17 pgs.
"Chinese Application Serial No. 201280042778.8, Response filed May 25, 2016 to Office Action dated Feb. 3, 2016", w/ English Translation, 11 pgs.
"Chinese Application Serial No. 201280042778.8, Response filed Nov. 16, 2016 to Office Action dated Sep. 7, 2016", w/ English Translation, 44 pgs.
"Chinese Application Serial No. 201380042926.0, Decision of Rejection dated Jan. 5, 2018", w/ English Claims, 11 pgs.
"Chinese Application Serial No. 201380042926.0, Office Action dated Feb. 26, 2016", w/ English Translation, 15 pgs.
"Chinese Application Serial No. 201380042926.0, Office Action dated May 11, 2017", W/ English Translation, 13 pgs.
"Chinese Application Serial No. 201380042926.0, Office Action dated Sep. 28, 2016", w/ English Translation, 12 pgs.
"Chinese Application Serial No. 201380042926.0, Request for Reexamination filed Apr. 20, 2018 to Decision of Rejection dated Jan. 5, 2018", w/ English Claims, 52 pgs.
"Chinese Application Serial No. 201380042926.0, Response filed Feb. 13, 2017 to Office Action dated Sep. 28, 2016", w/ English Amended Claims, 56 pgs.
"Chinese Application Serial No. 201380042926.0, Response filed Jul. 7, 2016 to Office Action dated Feb. 26, 2016", w/ English Claims, 40 pgs.
"Chinese Application Serial No. 201380042926.0, Response filed Sep. 26, 2017 to Office Action dated May 11, 2017", w/ English Claims (not amended), 13 pgs.
"Chinese Application Serial No. 201380044484.3, Examiner Interview Summary dated Jan. 3, 2018", w/ English Translation, 1 pg.
"Chinese Application Serial No. 201380044484.3, Office Action dated Jan. 13, 2017", w/ English Translation, 16 pgs.
"Chinese Application Serial No. 201380044484.3, Office Action dated Mar. 28, 2016", w/ English Translation, 16 pgs.
"Chinese Application Serial No. 201380044484.3, Office Action dated Jul. 31, 2017", w/ English Translation, 21 pgs.
"Chinese Application Serial No. 201380044484.3, Response filed Jan. 3, 2018 to Examiner Interview Summary dated Jan. 3, 2018", w/ English Claims, 53 pgs.
"Chinese Application Serial No. 201380044484.3, Response filed Mar. 28, 2017 to Office Action dated Jan. 13, 2017", w/ English Claims, 58 pgs.
"Chinese Application Serial No. 201380044484.3, Response filed Oct. 12, 2016 to Office Action dated Mar. 28, 2016", w/ English Claims, 54 pgs.
"Chinese Application Serial No. 201380044484.3, Response filed Oct. 12, 2017 to Office Action dated Jul. 31, 2017", w/ English Claims, 54 pgs.
"Chinese Application Serial No. 201480014783.7, Office Action dated Mar. 26, 2018", w/ English Translation, 16 pgs.
"Chinese Application Serial No. 201480014783.7, Office Action dated Jun. 30, 2017", w/ English Translation, 19 pgs.
"Chinese Application Serial No. 201480014783.7, Response filed Jun. 11, 2018 to Office Action dated Mar. 26, 2018", w/ English Claims, 18 pgs.
"Chinese Application Serial No. 201480014783.7, Response filed Nov. 10, 2017 to Office Action dated Jun. 30, 2017", w/ English Claims, 48 pgs.
"Chinese Application Serial No. 201480015355.6, Office Action dated Jun. 14, 2018", w/ English Summary, 8 pgs.
"Chinese Application Serial No. 201480015355.6, Office Action dated Oct. 13, 2017", w/ English Translation, 13 pgs.
"Chinese Application Serial No. 201480015355.6, Office Action dated Nov. 28, 2016", w/ English Translation, 16 pgs.
"Chinese Application Serial No. 201480015355.6, Response filed Feb. 28, 2018 to Office Action dated Oct. 13, 2017", w/ English Claims, 36 pgs.
"Chinese Application Serial No. 201480015355.6, Response filed Jun. 13, 2017 to Office Action dated Nov. 28, 2016", w/ English Claims, 36 pgs.
"Chinese Application Serial No. 201480015422.4, Office Action dated Nov. 1, 2016", w/ English Translation, 13 pgs.
"Chinese Application Serial No. 201480015422.4, Response filed May 12, 2017 to Office Action dated Nov. 1, 2016", w/ English Claims, 47 pgs.
"Chinese Application Serial No. 201480015766.5, Office Action dated Oct. 19, 2016", w/ English Translation, 9 pgs.
"Chinese Application Serial No. 201480015766.5, Response filed Jan. 20, 2017 to Office Action dated Oct. 19, 2016", w/ English Claims, 52 pgs.
"Chinese Application Serial No. 201480016150.X, Office Action dated Jun. 19, 2017", w/ English Translation, 22 pgs.
"Chinese Application Serial No. 201480016150.X, Response filed Nov. 2, 2017 to Office Action dated Jun. 19, 2017", w/ English Claims, 82 pgs.
"Dehumidification Solutions", Des Champs Laboratories, Inc., (2001), 18 pgs.
"Desi-WringerTM Precision Desiccant Dehumidification Systems", Des Champs Technologies, (2007), 12 pgs.
"Energy Recovery—Fresh in Air Quality", SEMCO Inc., (published before Apr. 12, 2012), 131 pgs.
"European Application Serial No. 11797695.1, Extended European Search Report dated Jan. 25, 2016", 11 pgs.
"European Application Serial No. 11797695.1, Partial Supplementary European Search Report dated Oct. 7, 2015", 6 pgs.
"European Application Serial No. 11797695.1, Response filed Aug. 22, 2016 to Office Action dated Feb. 11, 2016", 9 pgs.
"European Application Serial No. 12736074.1, Extended European Search Report dated Jul. 13, 2015", 8 pgs.
"European Application Serial No. 12736074.1, Response filed Oct. 2, 2015 to Extended European Search Report dated Jul. 13, 2015", 10 pgs.
"European Application Serial No. 12827918.9, Extended European Search Report dated Jul. 6, 2015", 6 pgs.
"European Application Serial No. 12827918.9, Response filed Sep. 28, 2015 to Extended European Search Report dated Jul. 6, 2015", 8 pgs.
"European Application Serial No. 13830357.3, Extended European Search Report dated Jun. 8, 2016", 5 pgs.
"European Application Serial No. 13830357.3, Response filed Dec. 23, 2016 to Extended European Search Report dated Jun. 8, 2016", 11 pgs.
"European Application Serial No. 13830940.6, Extended European Search Report dated Jul. 4, 2016", 5 pgs.

(56) References Cited

OTHER PUBLICATIONS

"European Application Serial No. 13830940.6, Response filed Jan. 16, 2017 to Communication Pursuant to Rules 70(2) and 70a(2) EPC dated Jul. 21, 2016", 1 pg.
"European Application Serial No. 14764192.2, Extended European Search Report dated Oct. 27, 2016", 7 pgs.
"European Application Serial No. 14764192.2, Response filed Jan. 30, 2017 to Extended European Search Report dated Oct. 27, 2016", 19 pgs.
"European Application Serial No. 14764192.2, Response filed Apr. 13, 2016 to Communication Pursuant Rules 161(2) and 162 EPC dated Nov. 19, 2015", 9 pgs.
"European Application Serial No. 14764305.0, Extended European Search Report dated Apr. 4, 2017", 8 pgs.
"European Application Serial No. 14764305.0, Response filed Apr. 13, 2016 to Communication Pursuant to Article 94(3) EPC dated Oct. 8, 2015", 10 pgs.
"European Application Serial No. 14764305.0, Response filed Oct. 31, 2017 to Extended European Search Report dated Apr. 4, 2017", 7 pgs.
"European Application Serial No. 14764318.3, Extended European Search Report dated Mar. 15, 2017", 10 pgs.
"European Application Serial No. 14764318.3, Response filed Jan. 28, 2016 to Communication pursuant to Rules 161(1) and 162 EPC dated Nov. 19, 2015", 17 pgs.
"European Application Serial No. 14764318.3, Response filed Oct. 10, 2017 to Extended European Search Report dated Mar. 15, 2017", 11 pgs.
"European Application Serial No. 14764713.5, Extended European Search Report dated Dec. 9, 2016", 6 pgs.
"European Application Serial No. 14764713.5, Response filed Jan. 28, 2016 to Communication pursuant to Rules 161(1) and 162 EPC dated Dec. 2, 2015", 9 pgs.
"European Application Serial No. 14764713.5, Response filed Jul. 13, 2017 to Extended European Search Report dated Dec. 9, 2016", 9 pgs.
"European Application Serial No. 14765396.8, Extended European Search Report dated Oct. 28, 2016", 6 pgs.
"European Application Serial No. 14765396.8, Office Action dated Nov. 20, 2015", 2 pgs.
"European Application Serial No. 14765396.8, Response filed Jan. 29, 2016 to Office Action dated Nov. 20, 2015", 12 pgs.
"European Application Serial No. 14765396.8, Response filed May 25, 2017 to Extended European Search Report dated Oct. 28, 2016", 5 pgs.
"European Application Serial No. 15834201.4, Extended European Search Report dated Mar. 16, 2018", 8 pgs.
"European Application Serial No. 15834201.4, Response filed Oct. 9, 2017 to Communication Pursuant to Rules 161(2) and 162 EPC dated Mar. 29, 2017", 15 pgs.
"European Application Serial No. 16795581.4, Response filed Aug. 6, 2018 to Communication Pursuant to Rules 161(2) and 162 EPC dated Jan. 26, 2018", 16 pgs.
"European Application Serial No. 16795582.2, Response filed Jul. 17, 2018 to Communication Pursuant to Rules 161(2) and 162 EPC dated Jan. 8, 2018", 12 pgs.
"European Application Serial No. 18153408.2, Communication Pursuant to Rule 55 EPC dated May 17, 2018", 2 pgs.
"International Application Serial No. PCT/CA2012/000055, International Preliminary Report on Patentability dated Aug. 1, 2013", 9 pgs.
"International Application Serial No. PCT/CA2012/000055, International Search Report dated May 24, 2012", 4 pgs.
"International Application Serial No. PCT/CA2012/000055, Invitation to Pay Add'l Fees and Partial Search Report dated Mar. 23, 2012", 2 pgs.
"International Application Serial No. PCT/CA2012/000055, Written Opinion dated May 24, 2012", 7 pgs.
"International Application Serial No. PCT/CA2012/00055, International Preliminary Report on Patentability dated Aug. 1, 2013", 9 pgs.
"International Application Serial No. PCT/CA2012/00055, International Search Report dated May 24, 2012", 4 pgs.
"International Application Serial No. PCT/CA2012/00055, Written Opinion dated May 24, 2012", 7 pgs.
"International Application Serial No. PCT/CA2012/000749, International Search Report dated Oct. 26, 2012", 3 pgs.
"International Application Serial No. PCT/CA2012/000749, Written Opinion dated Oct. 26, 2012", 5 pgs.
"International Application Serial No. PCT/CA2013/000608, International Preliminary Report on Patentability dated Mar. 5, 2015", 7 pgs.
"International Application Serial No. PCT/CA2013/000608, International Search Report dated Sep. 23, 2013", 3 pgs.
"International Application Serial No. PCT/CA2013/000608, Written Opinion dated Sep. 23, 2013", 5 pgs.
"International Application Serial No. PCT/CA2013/000609, International Preliminary Report on Patentability dated Mar. 5, 2015", 7 pgs.
"International Application Serial No. PCT/CA2013/000609, International Search Report dated Sep. 17, 2013", 3 pgs.
"International Application Serial No. PCT/CA2013/000609, Written Opinion dated Sep. 17, 2013", 5 pgs.
"International Application Serial No. PCT/CA2013/000964, International Search Report dated Feb. 7, 2014", 3 pgs.
"International Application Serial No. PCT/CA2013/000964, Written Opinion dated Feb. 7, 2014", 6 pgs.
"International Application Serial No. PCT/CA2014/000048, International Preliminary Report on Patentability dated Sep. 24, 2015", 8 pgs.
"International Application Serial No. PCT/CA2014/000048, International Search Report dated Apr. 29, 2014", 3 pgs.
"International Application Serial No. PCT/CA2014/000048, Written Opinion dated Apr. 29, 2014", 6 pgs.
"International Application Serial No. PCT/CA2014/000083, International Preliminary Report on Patentability dated Sep. 24, 2015", 9 pgs.
"International Application Serial No. PCT/CA2014/000083, International Search Report dated May 14, 2014", 3 pgs.
"International Application Serial No. PCT/CA2014/000083, Written Opinion dated May 14, 2014", 7 pgs.
"International Application Serial No. PCT/CA2014/000148, International Preliminary Report on Patentability dated Sep. 24, 2015", 5 pgs.
"International Application Serial No. PCT/CA2014/000148, International Search Report dated May 9, 2014", 4 pgs.
"International Application Serial No. PCT/CA2014/000148, Written Opinion dated May 9, 2014", 3 pgs.
"International Application Serial No. PCT/CA2014/000169, International Preliminary Report on Patentability dated Sep. 24, 2015", 8 pgs.
"International Application Serial No. PCT/CA2014/000169, International Search Report dated May 27, 2014", 3 pgs.
"International Application Serial No. PCT/CA2014/000169, Written Opinion dated May 27, 2014", 6 pgs.
"International Application Serial No. PCT/CA2014/000171, International Preliminary Report on Patentability dated Sep. 24, 2015", 7 pgs.
"International Application Serial No. PCT/CA2014/000171, International Search Report dated May 27, 2014", 3 pgs.
"International Application Serial No. PCT/CA2014/000171, Written Opinion dated May 27, 2014", 5 pgs.
"International Application Serial No. PCT/CA2015/050787, International Search Report dated Nov. 4, 2015", 3 pgs.
"International Application Serial No. PCT/CA2015/050787, Written Opinion dated Nov. 4, 2015", 3 pgs.
"International Application Serial No. PCT/CA2016/050252, International Preliminary Report on Patentability dated Nov. 30, 2017", 6 pgs.
"International Application Serial No. PCT/CA2016/050252, International Search Report dated May 26, 2016", 3 pgs.

(56) References Cited

OTHER PUBLICATIONS

"International Application Serial No. PCT/CA2016/050252, Written Opinion dated May 26, 2016", 4 pgs.
"International Application Serial No. PCT/CA2016/050507, International Preliminary Report on Patentability dated Nov. 30, 2017", 5 pgs.
"International Application Serial No. PCT/CA2016/050507, International Search Report dated Jul. 21, 2016", 3 pgs.
"International Application Serial No. PCT/CA2016/050507, Written Opinion dated Jul. 21, 2016", 3 pgs.
"International Application Serial No. PCT/CA2017/050180, International Search Report dated Apr. 26, 2017", 3 pgs.
"International Application Serial No. PCT/CA2017/050180, Written Opinion dated Apr. 26, 2017", 4 pgs.
"International Application Serial No. PCT/IB2011/002145, International Preliminary Report on Patentability dated Jan. 10, 2013", 13 pgs.
"International Application Serial No. PCT/IB2011/002145, International Search Report dated Feb. 15, 2012", 7 pgs.
"International Application Serial No. PCT/IB2011/002145, Written Opinion dated Feb. 15, 2012", 11 pgs.
"International Application Serial No. PCT/IB2016/053799, International Preliminary Report on Patentability dated Jan. 4, 2018", 8 pgs.
"International Application Serial No. PCT/IB2016/053799, International Search Report dated Aug. 26, 2016", 3 pgs.
"International Application Serial No. PCT/IB2016/053799, Written Opinion dated Aug. 26, 2016", 6 pgs.
"International Application Serial No. PCT/US00/02956, International Preliminary Report on Patentability dated Jul. 9, 2001", 3 pgs.
"International Application Serial No. PCT/US00/02956, International Search Report dated Nov. 8, 2000", 1 pg.
"Meeting Programs", ASHRAE Technical Committee, (1997-2001), 13 pgs.
"Plane plate membrane contactor prototypes", University of Genoa, (Published prior to Mar. 28, 2013), 1 pg.
"Two-Wheel Desiccant Dehumidification System—Technology for Dehumidification and Improving Indoor Air Quality", Federal Technology Alert, (Apr. 1997), 24 pgs.
Abdel-Salam, Mohamed R. H., et al., "Experimental Study of Effects of Phase-Change Energy and Operating Parameters on Performances of Two-Fluid and Three-Fluid Liquid-to-Air Membrane Energy Exchangers", ASHRAE Transactions, vol. 122, Part 1, (Jan. 2016), 134-145.
Abdel-Salam, Mohamed R. H., et al., "Performance testing of 2-fluid and 3-fluid liquid-to-air membrane energy exchangers for HVAC applications in cold-dry climates", International Journal of Heat and Mass Transfer, 106, (2017), 12 pgs.
Abdel-Salam, Mohamed R. H., et al., "Performance testing of a novel 3-fluid liquid-to-air membrane energy exchanger (3-fluid LAMEE) under desiccant solution regeneration operating conditions", International Journal of Heat and Mass Transfer, 95, (2015), 14 pgs.
Acker, William, "Industrial Dehumidification: Water Vapor Load Calculations and System Descriptions", HPAC Heating/Piping/Air Conditioning, (Mar. 1999), 49-59.
Bellia, L., et al., "Air Conditioning Systems With Desiccant Wheel for Italian Climates", International Journal on Architectural Science, vol. 1 No. 4, (2000), 193-213.
Bergero, Stefano, et al., "On the performances of a hybrid air-conditioning system in different climatic conditions", Energy 36(8), (2011), 13 pgs.
Bergero, Stefano, et al., "Performance analysis of a liquid desiccant and membrane contactor hybrid air-conditioning system", Energy and Buildings 42, (2010), 11 pgs.
Chant, Eileen E., et al., "A Steady-State Simulation of an Advanced Desiccant-Enhanced Cooling and Dehumidification System", ASHRAE Transactions: Research, (Jul. 1992), 339-347.
Coad, William J., "Conditioning Ventilation Air for Improved Performance and Air Quality", HPAC Heating/Piping/Air Conditioning, (Sep. 1999), 6 pgs.
Diblasio, Robert, "Desicants in Hospitals—Conditioning a Research Facility", Engineered Systems, (Sep. 1995), 4 pgs.
Downing, et al., "Operation and Maintenance for Quality Indoor Air", Proc. of the 7th Symposium on Improving Building Systems in Hot and Humid Climates, Ft. Worth, TX, (Oct. 9, 1990), 5 pgs.
Downing, Chris, "Humidity Control—No Place Like Home", Engineered Systems, (1996), 4 pgs.
Erb, Blake, et al., "Experimental Measurements of a Run-Around Membrane Energy Exchanger (RAMEE) with Comparison to a Numerical Model", ASHRAE Transactions, vol. 115, Part 2, (2009), 689-705.
Fischer, J., et al., "Active Desiccant Dehumidification Module Integration With Rooftop Packaged HVAC Units—Final Report Phase 3B", Oak Ridge National Laboratory, Final Report: Phase 3B, (Mar. 2002), 36 pgs.
Fischer, John C., "Optimizing IAQ, Humidity Control, and Energy Efficiency in School Environments Through the Application of Desiccant-Based Total Energy Recovery Systems", IAQ Atlanta: Paths to Better Building Environments/Environmental Effects on Heath and Productivity, (1996), 16 pgs.
Harriman, III, et al., "Dehumidification and Cooling Loads From Ventilation Air", ASHRAE Journal, (Nov. 1997), 7 pgs.
Harriman, III, et al., "Evaluating Active Desiccant Systems for Ventilating Commercial Buildings", ASHRAE Journal, (Oct. 1999), 7 pgs.
Harriman, III, et al., "New Weather Data for Energy Calculations", ASHRAE Journal, (Mar. 1999), 7 pgs.
Jeong, et al., "Energy Conservation Benefits of a Dedicated Outdoor Air System with Parallel Sensible Cooling by Ceiling Radiant Panels", ASHRAE Transactions; vol. 109, Part 2, (2003), 10 pgs.
Karniadakis, George E., et al., "Minimum-dissipation transport enhancement by flow destabilization: Reynolds' analogy revisited", J. Fluid Mech, vol. 192, (1988), 365-391.
Kosar, Douglas R., et al., "Dehumidification Issues of Standard 62-1989", ASHRAE Journal, (Mar. 1998), 71-75.
Larson, Michael David, et al., "The Performance of Membranes in a Newly Proposed Run-Around Heat and Moisture Exchanger", MS Thesis in Mechanical Engineering, University of Saskatchewan, Saskatoon, Canada, [Online] Retrieved from the internet: <URL: http://libran.usask.ca/theses/available/etd-12192006-094159/umestricted/LarsonThesis.pdf>, (Dec. 2006), 177 pgs.
Lepoudre, P., et al., "Channel Flow with Sinusoidal Screen Insert", Dept. of Mech Engineering, Univ. of Saskatchewan, Proceedings of the 19th Annual Conference of the CFD Society of Canada, Montreal, (Apr. 2011), 6 pgs.
Mahmud, Khizir, "Design and Performance Testing of Counter-Cross-Flow Run-Around Membrane Energy Exchanger System", MS Thesis in Mechanical Engineering, University of Saskatchewan, Saskatoon, Canada, [Online] Retrieved from the internet: <URL: http://libranusask.ca/theses/ available/ etd-09092009-223833/umestricted/KhizirMahmud2009-Sep-28a.pdf>, (Sep. 2009), 176 pgs.
Mahmud, Khizir, et al., "Performance testing of a counter-cross-flow run-around membrane energy exchanger (RAMEE) system for HVAC applications", Energy and Buildings, 42, (2010), 9 pgs.
McGahey, Kevin, et al., "Desiccants: Benefits forthe Second Century of Air Conditioning", Proceedings of the 10th Symposium on Improving Building Systems in Hot and Humid Climates, Ft. Worth, Texas, (May 14, 1996), 9 pgs.
McGahey, Kevin, "New Commercial Applications for Desiccant-Based Cooling", ASHRAE Journal, (Jul. 1998), 41-45.
Mumma, Stanley A., et al., "Achieving Dry Outside Air in an Energy-Efficient Manner", ASHRAE Transactions 2001, vol. 107, Part 1, (2001), 8 pgs.
Mumma, Stanley A., "Dedicated Outdoor Air-Dual Wheel System Control Requirements", ASHRAE Transactions, vol. 107, Part 1, (2001), 9 pgs.
Mumma, Stanley A., et al., "Extension of the Multiple Spaces Concept of ASH RAE Standard 62 to Include Infiltration, Exhaust/

(56) References Cited

OTHER PUBLICATIONS

Exfiltration, Interzonal Transfer, and Additional Short-Circuit Paths", ASHRAE Transactions: Symposia, (1998), 1232-1241.
Mumma, Stanley A, "Overview of Integrating Dedicated Outdoor Air Systems With Parallel Terminal Systems", ASHRAE Transactions vol. 107, Part 1, (2001), 7 pgs.
Nimmo, B. G., et al., "DEAC: Desiccant Enhancement of Cooling-Based Dehumidification", ASHRAE Transactions: Symposia, (1993), 842-848.
Qin, C. K., et al., "Engine-driven Desiccant-assisted Hybrid Air-conditioning System", 23rd World Gas Conference, Amsterdam, (2006), 15 pgs.
Ryan, K., et al., "Three-dimensional transition in the wake of bluff elongated cylinders", J. Fluid Mech., vol. 538, (2005), 29 pgs.
Scofield, C. Mike, et al., "HVAC Design for Classrooms: Divide and Conquer", Heating/Piping/Air Conditioning, (May 1993), 53-59.
Sevigny, Scoot P., et al., "Air Handling Unit Direct Digital Control System Retrofit to Provide Acceptable Indoor Air Quality and Global Energy Optimization", Energy Engineering, vol. 94, No. 5, (1997), 24-43.
Shank, Kurt M., et al., "Selecting the Supply Air Conditions for a Dedicated Outdoor Air System Working in Parallel with Distributed Sensible Cooling Terminal Equipment", ASHRAE Transactions, vol. 107, Part 1, (2001), 10 pgs.
Smith, Christopher S., et al., "Outdoor Air, Heat Wheels and JC Penny: A New Approach to Retail Ventilation", Proc. of the 11th Symposium on Improving Building Systems in Hot and Humid Climates, Ft. Worth, Texas, (Jun. 2, 1998), 1 pg.
Smith, James C., "Schools Resolve IAQ/Humidity Problems with Desiccant Preconditioning", Heating/Piping/Air Conditioning, (Apr. 1996), 6 pgs.
Sonin, Ain A., et al., "Optimization of Flow Design in Forced Flow Electrochemical Systems, with Special Application to Electrodialysis", Ind. Eng. Chem, Process Des. Develop vol. 13, No. 3, (1974), 8 pgs.
Swails, James F., et al., "A Cure for Growing Pains", Consulting Specifying Engineer, [Online] retrieved from the internet: <URL: http://www.csermag.com>, (Jun. 1997), 4 pgs.
Turpin, Joanna, "Dehumidification: The Problem No One Wants to Talk About", [Online] Retrieved from the internet: <URL: http//www.esmagazine.com/copyrighVde12c1c879ba8010VgnVCM100000f932a8c0_?>, (posted on Apr. 5, 2000), 6 pgs.
Vali, Alireza, "Modeling a Run-Around Heat and Moisture Exchanger Using Two Counter/Cross Flow Exchangers", MS Thesis in Mechanical Engineering, University of Saskatchewan, Saskatoon, Canada, [Online] Retrieved from the internet: <URL: http://library.usask.ca/theses/mailable/etd-06032009-15-J.6-J.-1./unrestricted/Vali.AlirezaThesis.pdf>, (2009), 193 pgs.
Vali, Alireza, et al., "Numerical model and effectiveness correlations for a run-around heat recovery system with combined counter and cross flow exchangers", International Journal of Heat and Mass Transfer 52, (2009), 14 pgs.
Woods, J, et al., "Desiccant Enhanced Evaporative Air Conditioning: Parametric Analysis and Design", 2nd International Conference on Building Energy and Environment (COBEE), (Oct. 2012), 10 pgs.
Yborra, Stephen C., "Field Evaluation of Desiccant-Integrated HVAC Systems: A Review of Case Studies in Multiple Commercial/Institutional Building Types", Proc. of the 11th Symposium on Improving Building Systems in Hot and Humid Climates, Ft. Worth, Texas, (Jun. 2, 1998), 10 pgs.
"U.S. Appl. No. 13/797,062, Non Final Office Action dated Dec. 28, 2018", 50 pgs.
"U.S. Appl. No. 13/797,062, Response filed Dec. 13, 2018 to Final Office Action dated Jul. 13, 2018", 12 pgs.
"U.S. Appl. No. 14/171,951, Notice of Allowance dated Jan. 9, 2019", 6 pgs.
"U.S. Appl. No. 14/187,413, Advisory Action dated Dec. 17, 2018", 5 pgs.
"U.S. Appl. No. 14/187,413, Amendment and Response filed Nov. 30, 2018 to Final Office Action dated Jul. 26, 2018", 19 pgs.
"U.S. Appl. No. 14/192,019, Final Office Action dated Jan. 10, 2019", 16 pgs.
"U.S. Appl. No. 14/192,019, Response filed Sep. 11, 2018 to Non Final Office Action dated May 11, 2018", 12 pgs.
"U.S. Appl. No. 14/830,492, Final Office Action dated Dec. 28, 2018", 9 pgs.
"U.S. Appl. No. 14/830,492, Response filed Aug. 15, 2018 to Non Final Office Action dated Mar. 15, 2018", 12 pgs.
"U.S. Appl. No. 14/957,795, Corrected Notice of Allowability dated Feb. 1, 2019", 4 pgs.
"U.S. Appl. No. 14/957,795, Notice of Allowance dated Jan. 17, 2019", 7 pgs.
"U.S. Appl. No. 14/957,795, Notice of Allowance dated Sep. 11, 2018", 9 pgs.
"U.S. Appl. No. 15/185,155, Corrected Notice of Allowability dated May 15, 2019", 2 pgs.
"U.S. Appl. No. 15/185,155, Corrected Notice of Allowability dated May 22, 2019", 2 pgs.
"U.S. Appl. No. 15/185,155, Examiner Interview Summary dated Feb. 21, 2019", 3 pgs.
"U.S. Appl. No. 15/185,155, Final Office Action dated Dec. 5, 2018", 11 pgs.
"U.S. Appl. No. 15/185,155, Notice of Allowance dated Mar. 25, 2019", 7 pgs.
"U.S. Appl. No. 15/185,155, Response filed Mar. 5, 2019 to Final Office Action dated Dec. 5, 2018", 9 pgs.
"U.S. Appl. No. 15/185,180, Non Final Office Action dated Jan. 8, 2019", 14 pgs.
"U.S. Appl. No. 15/185,180, Response filed Nov. 19, 2018 to Restriction Requirement dated Jun. 21, 2018", 9 pgs.
"U.S. Appl. No. 15/185,180, Response filed May 1, 2019 to Non Final Office Action dated Jan. 8, 2019", 11 pgs.
"U.S. Appl. No. 15/574,201, Non Final Office Action dated Jan. 29, 2019", 6 pgs.
"U.S. Appl. No. 15/574,201, Response Filed Jan. 7, 2019 to Restriction Requirement dated Sep. 5, 2018", 8 pgs.
"U.S. Appl. No. 15/574,201, Restriction Requirement dated Sep. 5, 2018", 6 pgs.
"U.S. Appl. No. 15/574,205, Non Final Office Action dated Sep. 11, 2018", 6 pgs.
"U.S. Appl. No. 15/574,205, Notice of Allowance dated Feb. 13, 2019", 6 pgs.
"U.S. Appl. No. 15/574,205, Response filed Jan. 11, 2019 to Non-Final Office Action dated Sep. 11, 2018", 12 pgs.
"U.S. Appl. No. 15/590,685, Advisory Action dated Dec. 12, 2018", 3 pgs.
"U.S. Appl. No. 15/590,685, Non Final Office Action dated Jan. 11, 2019", 13 pgs.
"U.S. Appl. No. 15/590,685, Response filed Apr. 18, 2019 to NonFinal Office Action dated Jan. 11, 2019", 11 pgs.
"U.S. Appl. No. 15/590,685, Response filed Nov. 30, 2018 to Final Office Action dated Jun. 7, 2018", 10 pgs.
"U.S. Appl. No. 15/739,016, Non Final Office Action dated Feb. 13, 2019", 6 pgs.
"U.S. Appl. No. 15/739,016, Response filed Jan. 28, 2019 to Restriction Requirement dated Nov. 26, 2018", 8 pgs.
"U.S. Appl. No. 15/739,016, Restriction Requirement dated Nov. 26, 2018", 5 pgs.
"U.S. Appl. No. 15/814,153, Restriction Requirement dated May 15, 2019", 6 pgs.
"Australian Application Serial No. 2014231667, Response filed Jan. 15, 2019 to Subsequent Examiners Report dated Aug. 29, 2018", 12 pgs.
"Australian Application Serial No. 2014231667, Subsequent Examiners Report dated Aug. 29, 2018", 4 pgs.
"Australian Application Serial No. 2017204552, First Examination Report dated Oct. 9, 2018", 3 pgs.
"Canadian Application Serial No. 2,801,352, Response filed Jan. 29, 2019 to Office Action dated Aug. 2, 2018", 12 pgs.
"Canadian Application Serial No. 2,880,350, Examiner's Rule 30(2) Requisition mailed May 1, 2019", 4 pgs.
"Canadian Application Serial No. 2,880,353, Office Action dated Apr. 29, 2019", 4 pgs.

(56) References Cited

OTHER PUBLICATIONS

"Chinese Application Serial No. 201380042926.0, Decision of Reexamination-Upholding Decision of Rejection dated Mar. 15, 2019", w/ English Translation, 18 pgs.
"Chinese Application Serial No. 201380042926.0, Notice of Reexamination dated Aug. 23, 2018", w/ English Machine Translation, 18 pgs.
"Chinese Application Serial No. 201380042926.0, Response filed Dec. 7, 2018 to Notice of Reexamination dated Aug. 23, 2018", w/ English Translation, 15 pgs.
"Chinese Application Serial No. 201480015355.6, Decision of Rejection dated Mar. 18, 2019", w/ English Summary, 7 pgs.
"Chinese Application Serial No. 201480015355.6, Response filed Dec. 4, 2018 to Office Action dated Jun. 14, 2018", w/ English Claims, 16 pgs.
"Chinese Application Serial No. 201680048895.3, Office Action dated Apr. 17, 2019", w/ English Translation, 33 pgs.
"Chinese Application Serial No. 201710708143.1, Office Action dated Dec. 29, 2018", w/ English Translation, 9 pgs.
"Chinese Application Serial No. 201710708143.1, Response filed Apr. 29, 2019 to Office Action dated Dec. 29, 2018", w/ English Claims, 10 pgs.
"European Application Serial No. 11797695.1, Communication Pursuant to Article 94(3) EPC dated Aug. 24, 2018", 5 pgs.
"European Application Serial No. 11797695.1, Response filed Jan. 9, 2019 to Communication Pursuant to Article 94(3) EPC dated Aug. 24, 2018", 11 pgs.
"European Application Serial No. 14764305.0, Communication Pursuant to Article 94(3) EPC dated Feb. 14, 2019", 4 pgs.
"European Application Serial No. 14764713.5, Communication pursuant to Article 94(3) EPC dated Dec. 18, 2018", 3 pgs.
"European Application Serial No. 14765396.8, Communication Pursuant to Article 94(3) EPC dated Dec. 5, 2018", 4 pgs.
"European Application Serial No. 14765396.8, Response filed May 23, 2019 to Communication Pursuant to Article 94(3) EPC dated Dec. 5, 2018", 16 pgs.
"European Application Serial No. 15834201.4, Response filed Oct. 15, 2018 to Extended European Search Report dated Mar. 16, 2018", 17 pgs.
"European Application Serial No. 16795581.4, Extended European Search Report dated Feb. 12, 2019", 9 pgs.
"European Application Serial No. 16795582.2, Extended European Search Report dated Nov. 20, 2018", 8 pgs.
"European Application Serial No. 16813836.0, Extended European Search Report dated Mar. 25, 2019", 9 pgs.
"European Application Serial No. 16813836.0, Partial Supplementary European Search Report dated Dec. 5, 2018", 11 pgs.
"European Application Serial No. 16813836.0, Response filed Aug. 21, 2018 to Communication Pursuant to Rules 161 (2) and 162 EPC dated Feb. 13, 2018", 37 pgs.
"European Application Serial No. 17762365.9, Response filed Apr. 25, 2019 to Communication Pursuant to Rules 161 and 162 dated Oct. 16, 2018", 12 pgs.
"European Application Serial No. 18153408.2, Extended European Search Report dated Dec. 4, 2018", 5 pgs.
"European Application Serial No. 18160812.6, Extended European Search Report dated Feb. 11, 2019", 6 pgs.
"European Application Serial No. 18211142.7, Extended European Search Report dated Apr. 11, 2019", 6 pgs.
"European Application Serial No. 18214518.5, Extended European Search Report dated Apr. 17, 2019", 5 pgs.
"International Application Serial No. PCT/CA2017/050180, International Preliminary Report on Patentability dated Sep. 20, 2018", 6 pgs.
"International Search Report and Written Opinion", PCT Search Report from, 9 pgs.
"Machine Translation of JP 09113167 A", Espacenet Patent Translate, [Online] Retrieved by the examiner: <URL: https://worldwide.espacenet.com/publicationDetails/description?CC=JP&NR=H09113167A&KC=A&FT=D&ND=3&date=19970502&DB=&locale=en_EP>, (retrieved Dec. 24, 2018), 7 pgs.
"Munters PFC Polymer Fluid Cooler", Munters Corp., (Sep. 2015), 2 pgs.
"Oasis PFC Polymer Fluid Cooler Product Information", Munters Corp., (Nov. 2013), 2 pgs.
"Singapore Application Serial No. 11201710777Y, Office Action dated Jan. 31, 2019", in English, 7 pgs.
"Singapore Application Serial No. 11201709404P, Written Opinion dated Feb. 22, 2019", in English, 8 pgs.
"Translation of CN 201906567 U", Espacenet Patent Translate, [Online] Retrieved by the examiner: <URL: http://translationportal.epo.org/emtp/translate/?ACTION=description-retrieval&COUNTRY=CN&ENGINE=google&FORMAT=docdb&KIND=U&LOCALE=en_EP&NUMBER=201906567&OPS=ops.epo.org/3.2&SRCLANG=zh&TRGLANG=en>, (retrieved Feb. 2, 2018), 4 pgs.
Larson, Michael D., et al., "The elastic and moisture transfer properties of polyethylene and polypropylene membranes for use in liquid-to-air energy exchangers", Journal of Membrane Science 302, (2007), 14 pgs.
"U.S. Appl. No. 13/797,062 , Appeal Decision mailed Jun. 18, 2021", 12 pgs.
"U.S. Appl. No. 13/797,062, Appeal Brief filed Mar. 25, 2020", 27 pgs.
"U.S. Appl. No. 13/797,062, Final Office Action dated Jul. 25, 2019", 50 pgs.
"U.S. Appl. No. 13/797,062, Respnose filed Jun. 28, 2019 to Non Final Office Action dated Jun. 28, 2019", 12 pgs.
"U.S. Appl. No. 14/171,951, Notice of Allowance dated Nov. 6, 2019", 6 pgs.
"U.S. Appl. No. 14/187,413 Response to Non-Final Office Action filed Jun. 2, 2020", 25 pgs.
"U.S. Appl. No. 14/187,413, Examiner's Answer dated Jun. 11, 2021", 10 pgs.
"U.S. Appl. No. 14/187,413, Final Office Action dated Jun. 15, 2020", 19 pgs.
"U.S. Appl. No. 14/187,413, Non Final Office Action dated Jul. 31, 2019", 22 pgs.
"U.S. Appl. No. 14/192,019, Non Final Office Action dated Jun. 25, 2019", 13 pgs.
"U.S. Appl. No. 14/192,019, Response filed Jun. 10, 2019 to Final Office Action dated Jan. 20, 2019", 10 pgs.
"U.S. Appl. No. 14/830,492, Corrected Notice of Allowability dated Jun. 15, 2020", 2 pgs.
"U.S. Appl. No. 14/830,492, Notice of Allowance dated Feb. 27, 2020", 5 pgs.
"U.S. Appl. No. 14/830,492, Notice of Allowance dated Sep. 24, 2019", 7 pgs.
"U.S. Appl. No. 14/830,492, Response filed Jun. 29, 2019 to Final Office Action dated Dec. 28, 2018", 6 pgs.
"U.S. Appl. No. 15/185,155, Notice of Allowance dated Jul. 17, 2019", 8 pgs.
"U.S. Appl. No. 15/185,180, Final Office Action dated Jul. 31, 2019", 15 pgs.
"U.S. Appl. No. 15/185,180, Notice of Allowance dated Oct. 15, 2020", 6 pgs.
"U.S. Appl. No. 15/590,685, Examiner Interview Summary dated Dec. 11, 2020", 3 pgs.
"U.S. Appl. No. 15/590,685, Final Office Action dated Jun. 26, 2019", 14 pgs.
"U.S. Appl. No. 15/590,685, Non Final Office Action dated Jan. 7, 2020", 15 pgs.
"U.S. Appl. No. 15/590,685, Notice of Allowance dated Feb. 9, 2021", 6 pgs.
"U.S. Appl. No. 15/590,685, PTO Response to Rule 312 Communication dated Apr. 27, 2021", 2 pgs.
"U.S. Appl. No. 15/590,685, Response filed Dec. 19, 2019 to Final Office Action dated Jun. 26, 2019", 11 pgs.
"U.S. Appl. No. 15/739,016, Corrected Notice of Allowability dated Jul. 1, 2020", 2 pgs.
"U.S. Appl. No. 15/739,016, Notice of Allowance dated Mar. 25, 2020", 5 pgs.

(56) References Cited

OTHER PUBLICATIONS

"U.S. Appl. No. 15/739,016, Notice of Allowance dated Aug. 1, 2019", 6 pgs.
"U.S. Appl. No. 15/739,016, Notice of Allowance dated Nov. 20, 2019", 7 pgs.
"U.S. Appl. No. 16/351,046, Non Final Office Action dated Dec. 21, 2020", 8 pgs.
"U.S. Appl. No. 16/784,822, Supplemental Preliminary Amendment filed Feb. 14, 2020", 6 pgs.
"U.S. Appl. No. 17/168,928, Supplemental Preliminary Amendment filed Aug. 12, 2021", 5 pages.
"U.S. Appl. No. 17/345,852 Preliminary Amendment filed with Application", 3 pgs.
"Australian Application Serial No. 2015306040, First Examination Report dated Nov. 8, 2019", 4 pgs.
"Australian Application Serial No. 2016265882, First Examination Report dated Aug. 5, 2020", 4 pgs.
"Australian Application Serial No. 2016265883, First Examination Report dated Sep. 22, 2020", 4 pgs.
"Australian Application Serial No. 2016281963, First Examination Report dated Oct. 15, 2020", 5 pgs.
"Australian Application Serial No. 2018202342, First Examination Report dated Jun. 17, 2019", 5 pgs.
"Australian Application Serial No. 2018202342, Response filed Aug. 1, 2019 to First Examination Report dated Jun. 17, 2019", 17 pgs.
"Australian Application Serial No. 2018202342, Subsequent Examiners Report dated Aug. 23, 2019", 4 pgs.
"Australian Application Serial No. 2018204774, First Examination Report dated Jul. 18, 2019", 4 pgs.
"Australian Application Serial No. 2018204774, Response filed May 28, 2020 to First Examination Report dated Jul. 18, 2019", 14 pgs.
"Australian Application Serial No. 2018226496, First Examination Report dated Jul. 25, 2019", 4 pgs.
"Australian Application Serial No. 2018236791, First Examination Report dated Mar. 2, 2020", 3 pgs.
"Australian Application Serial No. 2018236791, Response filed Jun. 9, 2020 to First Examination Report dated Mar. 2, 2020", 12 pgs.
"Australian Application Serial No. 2018236791, Voluntary Amendment filed Dec. 3, 2018", 8 pgs.
"Australian Application Serial No. 2019201063, First Examination Report dated Aug. 6, 2019", 7 pgs.
"Australian Application Serial No. 2019250148, First Examination Report dated Nov. 23, 2020", 5 pgs.
"Canadian Application Serial No. 2,880,350, Response filed Oct. 28, 2020 to Examiner's Rule 30(2) Requisition dated May 1, 2019", 36 pgs.
"Canadian Application Serial No. 2,880,350, Voluntary Amendment filed Apr. 29, 2021", 7 pgs.
"Canadian Application Serial No. 2,880,353, Response filed Oct. 29, 2019 to Office Action dated Apr. 29, 2019", 28 pgs.
"Canadian Application Serial No. 2,901,484, Office Action dated Apr. 27, 2021", 4 pgs.
"Canadian Application Serial No. 2,901,484, Office Action dated Jun. 5, 2020", 6 pgs.
"Canadian Application Serial No. 2,901,484, Office Action dated Dec. 11, 2019", 6 pgs.
"Canadian Application Serial No. 2,901,484, Response filed Apr. 7, 2020 to Office Action dated Dec. 11, 2019", 25 pgs.
"Canadian Application Serial No. 2,901,484, Response filed Sep. 29, 2020 to Office Action dated Jun. 5, 2020", 20 pgs.
"Canadian Application Serial No. 2,901,492, Office Action dated Jan. 29, 2020", 4 pgs.
"Canadian Application Serial No. 2,901,495, Office Action dated Jan. 29, 2020", 4 pgs.
"Canadian Application Serial No. 2,901,495, Response filed May 13, 2021 to Office Action dated Jan. 29, 2020", 23 pgs.
"Canadian Application Serial No. 2,904,224, Office Action dated Jan. 3, 2020", 4 pgs.
"Canadian Application Serial No. 2,904,224, Response filed May 11, 2021 to Office Action dated Jan. 3, 2020", 36 pgs.
"Canadian Application Serial No. 3,034,592, Office Action dated Mar. 17, 2020", 5 pgs.
"Canadian Application Serial No. 3,034,592, Response filed Jul. 14, 2020 to Office Action dated Mar. 17, 2020", 20 pgs.
"Canadian Application Serial No. 3,046,529, Office Action dated Mar. 5, 2020", 4 pgs.
"Canadian Application Serial No. 3,046,529, Office Action dated Sep. 18, 2019", 6 pgs.
"Canadian Application Serial No. 3,046,529, Response filed Nov. 14, 2019 to Office Action dated Sep. 18, 2019", 9 pgs.
"Chinese Application Serial No. 201580053421.3, Office Action dated Sep. 17, 2019", w/ English Translation, 31 pgs.
"Chinese Application Serial No. 201680038134.X, Office Action dated Apr. 7, 2020", w/ English Translation, 29 pgs.
"Chinese Application Serial No. 201680038134.X, Office Action dated Jul. 8, 2019", w/ English Translation, 30 pgs.
"Chinese Application Serial No. 201680038134.X, Response filed Jan. 23, 2020 to Office Action dated Jul. 8, 2019", w/ English claims, 32 pgs.
"Chinese Application Serial No. 201680038134.X, Response filed Aug. 24, 2020 to Office Action dated Apr. 7, 2020", w/ English Translation, 24 pgs.
"Chinese Application Serial No. 201680038134.X, Response to Examiner Telephone Interview filed Oct. 20, 2020", w/ English Claims, 26 pgs.
"Chinese Application Serial No. 201680038135.4, Office Action dated Apr. 8, 2021", w/ English Machine Translation, 7 pgs.
"Chinese Application Serial No. 201680038135.4, Office Action dated Jun. 28, 2020", w/ English Translation, 25 pgs.
"Chinese Application Serial No. 201680038135.4, Office Action dated Aug. 26, 2019", w/ English Translation, 23 pgs.
"Chinese Application Serial No. 201680038135.4, Response filed Mar. 10, 2020 to First Office Action dated Aug. 26, 2019", w/ English Translation, 12 pgs.
"Chinese Application Serial No. 201680038135.4, Response filed Nov. 13, 2020 to Office Action dated Jun. 28, 2020", w/ current English claims, claims not amended in response filed, 8 pgs.
"Chinese Application Serial No. 201680048895.3, Office Action dated Apr. 15, 2020", w/ English Translation, 12 pgs.
"Chinese Application Serial No. 201680048895.3, Response filed Aug. 31, 2020 to Office Action dated Apr. 15, 2020", w/ English claims, 25 pgs.
"Chinese Application Serial No. 201680048895.3, Response filed Nov. 4, 2019 to Office Action dated Apr. 17, 2019", w/ English claims, 29 pgs.
"Chinese Application Serial No. 201680048895.3, Response to Examiner Telephone Interview filed Oct. 22, 2020", w/ English claims, 22 pgs.
"Chinese Application Serial No. 201710339973.1, Office Action dated Apr. 26, 2019", w/ English Translation, 9 pgs.
"Chinese Application Serial No. 201710339973.1, Response filed Jul. 3, 2019 to Office Action dated Apr. 26, 2019", w/ English Claims, 14 pgs.
"Chinese Application Serial No. 201710708143.1, Office Action dated Aug. 16, 2019", w/ English Translation, 10 pgs.
"Chinese Application Serial No. 201710708143.1, Response filed Sep. 27, 2019 to Office Action dated Aug. 16, 2019", w/ English claims, 10 pgs.
"Chinese Application Serial No. 201780027034.1, Office Action dated Mar. 5, 2021", w/ English Translation, 7 pgs.
"Chinese Application Serial No. 201780027034.1, Office Action dated Apr. 13, 2020", w/ English Translation, 35 pgs.
"Chinese Application Serial No. 201780027034.1, Response filed Oct. 28, 2020 to Office Action dated Apr. 13, 2020", w/ English claims, 46 pgs.
"Chinese Application Serial No. 201780027034.1, Response filed Oct. 28, 2020 to Office Action dated Apr. 13, 2020", w/ English Translation, 39 pgs.
"Chinese Application Serial No. 201810432187.0, Office Action dated Jan. 16, 2020", w/ English Translation, 12 pgs.

(56) References Cited

OTHER PUBLICATIONS

"Chinese Application Serial No. 201910516006.7, Office Action dated Mar. 1, 2021", w/ English Summary, 9 pgs.
"Chinese Application Serial No. 201910516006.7, Office Action dated Jul. 2, 2020", w/ English Translation, 16 pgs.
"Chinese Application Serial No. 201910516006.7, Response filed Jan. 18, 2021 to Office Action dated Jul. 2, 2020", w/ English claims, 21 pgs.
"Chinese Application Serial No. 201910516006.7, Voluntary Amendment filed Feb. 10, 2020", w/ English claims, 15 pgs.
"European Application Serial No. 11797695.1, Communication Pursuant to Article 94(3) EPC dated Nov. 19, 2020", 5 pgs.
"European Application Serial No. 11797695.1, Response filed Mar. 26, 2021 to Communication Pursuant to Article 94(3) EPC dated Nov. 19, 2020", 3 pgs.
"European Application Serial No. 14764305.0, Response filed Jun. 21, 2019 to Communication Pursuant to Article 94(3) EPC dated Feb. 14, 2019", 24 pgs.
"European Application Serial No. 14764713.5, Response filed Jun. 28, 2019 to Communication pursuant to Article 94(3) EPC dated Dec. 18, 2018", 8 pgs.
"European Application Serial No. 16795581.4, Response filed Sep. 11, 2019 to Extended European Search Report dated Feb. 12, 2019", 14 pgs.
"European Application Serial No. 16795582.2, Response filed Jun. 17, 2019 to Extended European Search Report dated Nov. 20, 2018", 16 pgs.
"European Application Serial No. 16813836.0, Communication Pursuant to Article 94(3) EPC dated Mar. 24, 2020", 5 pgs.
"European Application Serial No. 16813836.0, Response filed Aug. 3, 2020 to Communication Pursuant to Article 94(3) EPC dated Mar. 24, 2020", 8 pgs.
"European Application Serial No. 16813836.0, Response to Extended European Search Report dated Mar. 25, 2019", 11 pgs.
"European Application Serial No. 17762365.9, Extended European Search Report dated Oct. 17, 2019", 8 pgs.
"European Application Serial No. 17762365.9, Response filed May 15, 2020 to Extended European Search Report dated Oct. 17, 2019", 13 pgs.
"European Application Serial No. 18153408.2, Response filed Jul. 2, 2019 to Extended European Search Report dated Dec. 4, 2018", 12 pgs.
"European Application Serial No. 18160812.6, Communication Pursuant to Article 94(3) EPC dated Nov. 19, 2020", 4 pgs.
"European Application Serial No. 18160812.6, Response filed Mar. 2, 2021 to Communication Pursuant to Article 94(3) EPC dated Nov. 19, 2020", 2 pgs.
"European Application Serial No. 18160812.6, Response filed Aug. 6, 2019 to Extended European Search Report dated Feb. 11, 2019", 23 pgs.
"European Application Serial No. 18211142.7, Response filed Aug. 8, 2019 to Extended European Search Report dated Apr. 11, 2019", 10 pgs.
"European Application Serial No. 18214518.5, Response filed Jul. 16, 2019 to Extended European Search Report dated Apr. 17, 2019", 3 pgs.
"European Application Serial No. 20180081.0, Extended European Search Report dated Sep. 28, 2020", 7 pgs.
"European Application Serial No. 20180081.0, Response filed Apr. 20, 2021 to Extended European Search Report dated Sep. 28, 2020", 11 pgs.
"European Application Serial No. 21154403.6, Extended European Search Report dated Apr. 26, 2021", 8 pgs.
"Indian Application Serial No. 201717044889, First Examination Report dated Dec. 17, 2020", w/ English Translation, 6 pgs.
"Indian Application Serial No. 201717044889, Response filed Jun. 14, 2021 to First Examination Report dated Dec. 17, 2020", 82 pgs.
"Indian Application Serial No. 201717044890, First Examination Report dated Oct. 23, 2020", 6 pgs.
"Indian Application Serial No. 201817002765, First Examination Report dated Dec. 24, 2019", w/ English Translation, 6 pgs.
"Indian Application Serial No. 201817002765, Response filed Sep. 24, 2020 to First Examination Report dated Dec. 24, 2019", 30 pgs.
"Indian Application Serial No. 201817037404, First Examination Report dated Feb. 19, 2021", 7 pgs.
"Singapore Application Serial No. 11201710777Y, Response filed Jul. 1, 2019 to Office Action dated Jan. 31, 2019", in English, 31 pgs.
"Singaporean Application Serial No. 11201709404P, Response filed Jul. 22, 2019 to Written Opinion dated Feb. 22, 2019", in English, 62 pgs.
Abdel-Salam, Mohamed R.H., et al., "Design and testing of a novel 3-fluid liquid-to-air membrane energy exchanger (3-fluid LAMEE)", International Journal of Heat and Mass Transfer 92, (2016), 312-329.
Abdel-Salam, Mohamed R.H., et al., "Performance Testing of a Novel 3-Fluid Liquid-to-Air Membrane Energy Exchanger (3-Fluid LAMEE) for HVAC Applications", 28th Intl. Conference on Efficiency, Cost, Optimization, Simulation and Environmental Impact of Energy Systems (ECOS), Pau, France, (Jun. 30, 2015), 12 pgs.
"Canadian Application Serial No. 2,958,480, Office Action dated Sep. 16, 2021", 4 pages.
"U.S. Appl. No. 17/345,852 Supplemental Preliminary Amendment", 6 pages.

* cited by examiner

MEMBRANE-INTEGRATED ENERGY EXCHANGE ASSEMBLY

CROSS-REFERENCE TO RELATED APPLICATIONS

The present application is a continuation of U.S. patent application Ser. No. 14/190,715, entitled "Membrane-Integrated Energy Exchanger" filed Feb. 26, 2014 which relates to and claims priority benefits from U.S. Provisional Patent Application No. 61/783,048, entitled "Membrane-Integrated Energy Exchanger," filed Mar. 14, 2013, which are hereby expressly incorporated by reference in their entirety.

BACKGROUND OF THE DISCLOSURE

Embodiments of the present disclosure generally relate to an energy exchange assembly, and, more particularly, to an energy exchange assembly having one or more membranes that are configured to transfer sensible and/or latent energy therethrough.

Energy exchange assemblies are used to transfer energy, such as sensible and/or latent energy, between fluid streams. For example, air-to-air energy recovery cores are used in heating, ventilation, and air conditioning (HVAC) applications to transfer heat (sensible energy) and moisture (latent energy) between two airstreams. A typical energy recovery core is configured to precondition outdoor air to a desired condition through the use of air that is exhausted out of the building. For example, outside air is channeled through the assembly in proximity to exhaust air. Energy between the supply and exhaust air streams is transferred therebetween. In the winter, for example, cool and dry outside air is warmed and humidified through energy transfer with the warm and moist exhaust air. As such, the sensible and latent energy of the outside air is increased, while the sensible and latent energy of the exhaust air is decreased. The assembly typically reduces post-conditioning of the supply air before it enters the building, thereby reducing overall energy use of the system.

Energy exchange assemblies such as air-to-air recovery cores may include one or more membranes through which heat and moisture are transferred between air streams. Each membrane may be separated from adjacent membranes using a spacer. Stacked membrane layers separated by spacers form channels that allow air streams to pass through the assembly. For example, outdoor air that is to be conditioned may enter one side of the device, while air used to condition the outdoor air (such as exhaust air or scavenger air) enters another side of the device. Heat and moisture are transferred between the two airstreams through the membrane layers. As such, conditioned supply air may be supplied to an enclosed structure, while exhaust air may be discharged to an outside environment, or returned elsewhere in the building.

In an energy recovery core, for example, the amount of heat transferred is generally determined by a temperature difference and convective heat transfer coefficient of the two air streams, as well as the material properties of the membrane. The amount of moisture transferred in the core is generally governed by a humidity difference and convective mass transfer coefficients of the two air streams, but also depends on the material properties of the membrane.

Many known energy recovery assemblies that include membranes are assembled by either wrapping the membrane or by gluing the membrane to a substrate. Notably, the design and assembly of an energy recovery assembly may affect the heat and moisture transfer between air streams, which impacts the performance and cost of the device. For example, if the membrane does not properly adhere to the spacer, an increase in air leakage and pressure drop may occur, thereby decreasing the performance (measured as latent effectiveness) of the energy recovery core. Conversely, if excessive adhesive is used to secure the membrane to the spacer, the area available for heat and moisture transfer may be reduced, thereby limiting or otherwise reducing the performance of the energy recovery core. Moreover, the use of adhesives in relation to the membrane also adds additional cost and labor during assembly of the core. Further, the use of adhesives may result in harmful volatile organic compounds (VOCs) being emitted during initial use of an energy recovery assembly.

While energy recovery assemblies formed through wrapping techniques may reduce cost and minimize membrane waste, the processes of manufacturing such assemblies are typically labor intensive and/or use specialized automated equipment. The wrapping may also result in leaks at edges due to faulty seals. For example, gaps typically exist between membrane layers at corners of an energy recovery assembly. Further, at least some known wrapping techniques result in a seam being formed that extends along membrane layers. Typically, the seam is sealed using tape, which blocks pore structures of the membranes, and reduces the amount of moisture transfer in the assembly.

SUMMARY OF THE DISCLOSURE

Embodiments of the present disclosure provide energy exchange assemblies having one or more membranes that are directly integrated with an outer frame. Embodiments of the present disclosure may be formed without adhesives or wrapping.

Certain embodiments of the present disclosure provide a membrane panel configured to be secured within an energy exchange assembly. The membrane panel may include an outer frame defining a central opening, and a membrane sheet integrated with the outer frame. The membrane sheet spans across the central opening, and is configured to transfer one or both of sensible energy or latent energy therethrough. The membrane sheet may be integrated with the outer frame without an adhesive.

The outer frame may be injection-molded around edge portions of the membrane sheet. Alternatively, the membrane sheet may be ultrasonically bonded to the outer frame. In at least one other embodiment, the membrane sheet May be laser-bonded to the outer frame. In at least one other embodiment, the membrane sheet may be heat-sealed to the outer frame.

The outer frame may include a plurality of brackets having inner edges that define the central opening. One or more spacer-securing features, such as recesses, divots, slots, slits, tabs, or the like, may be formed through or in at least one of the inner edges. In at least one embodiment, the outer frame may include a plurality of upstanding corners.

In at least one embodiment, the outer frame fits together with at least one separate membrane spacer to form at least one airflow channel. In at least one embodiment, the outer frame may be integrally molded and formed with at least one membrane spacer.

Certain embodiments of the present disclosure provide an energy exchange assembly that may include a plurality of membrane spacers, and a plurality of membrane panels. Each of the plurality of membrane panels may include an outer frame defining a central opening defining a fluid channel, and a membrane sheet integrated with the outer frame. The membrane sheet spans across the central opening, and is configured to transfer one or both of sensible energy or latent energy therethrough. Each of the plurality of membrane spacers is positioned between two of the plurality of membrane panels.

In at least one embodiment, the plurality of membrane panels includes a first group of membrane panels and a second group of membrane panels. The first group of membrane panels may be orthogonally oriented with respect to the second group of membrane panels.

In at least one embodiment, each of the plurality of membrane spacers may include a connecting bracket having a reciprocal shape to the plurality of upstanding corners. The outer frame may include at least one sloped connecting bracket configured to mate with a reciprocal feature of one of the plurality of spacers. The plurality of spacers and the plurality of membrane panels may form stacked layers.

Certain embodiments of the present disclosure provide a method of forming a membrane panel configured to be secured within an energy exchange assembly. The method may include forming an outer frame defining a central opening, and integrating a membrane sheet with the outer frame. The membrane sheet spans across the central opening, and is configured to transfer one or both of sensible energy or latent energy therethrough.

The integrating operation may include injection-molding the outer frame around edge portions of the membrane sheet. In at least one other embodiment, the integrating operation includes ultrasonically bonding the membrane sheet to the outer frame. In at least one other embodiment, the integrating operation comprises laser-bonding the membrane sheet to the outer frame. In at least one other embodiment, the integrating operation includes heat-sealing the membrane sheet to the outer frame. The integrating operation may be performed without the use of an adhesive, such as glue, tape, or the like.

DETAILED DESCRIPTION OF THE DISCLOSURE

The foregoing summary, as well as the following detailed description of certain embodiments will be better understood when read in conjunction with the appended drawings. As used herein, an element or step recited in the singular and proceeded with the word "a" or "an" should be understood as not excluding plural of the elements or steps, unless such exclusion is explicitly stated. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Figure 1:
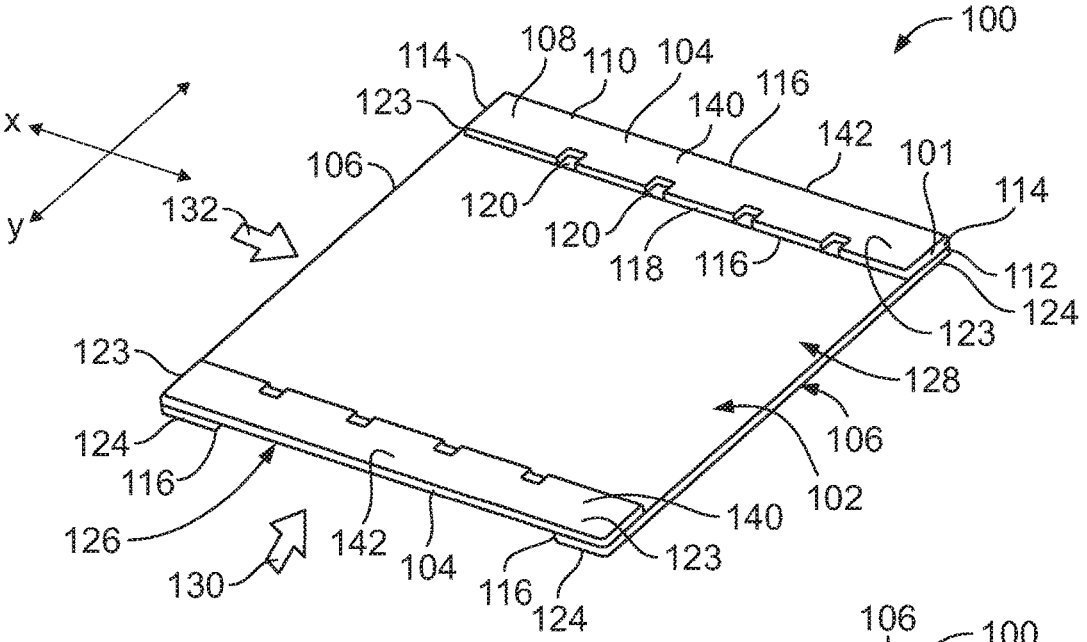
FIG. 1 illustrates a perspective top view of a membrane panel, according to an embodiment of the present disclosure.

FIG. 1 illustrates a perspective top view of a membrane panel 100, according to an embodiment of the present disclosure. The membrane panel 100 may be used in an energy exchange assembly, such as an energy recovery core, membrane heat exchanger, or the like. For example, a plurality of membrane panels 100 may be stacked to form an energy exchange assembly.

The membrane panel 100 includes an outer frame 101 that integrally retains a membrane sheet 102. The membrane sheet 102 is integrated with the membrane panel 100. The outer frame 101 may have a quadrilateral shape that defines a similarly shaped opening that receives and retains the membrane sheet 102. For example, the outer frame 101 may include end brackets 104 that are integrally connected to lateral brackets 106. The end brackets 104 may be parallel with one another and perpendicular to the lateral brackets 106. The opening may be defined by the end brackets 104 and the lateral brackets 106, which combine to provide four linear frame segments. In at least one embodiment, the area of the opening may be slightly less than the area defined by the end brackets 104 and the lateral brackets 106, thereby maximizing an area configured to transfer energy. The outer frame 101 may be formed of a plastic or a composite material. Alternatively, the outer frame 101 may be formed of various other shapes and sizes, such as triangular or round shapes.

Each of the end brackets 104 and the lateral brackets 106 may have the same or similar shape, size, and features. For example, each bracket 104 or 106 may include a planar main rectangular body 108 having opposed planar upper and lower surfaces 110 and 112, respectively, end edges 114, and opposed outer and inner edges 116 and 118, respectively. One or more spacer-securing features 120, such as recesses, divots, slots, slits, or the like, may be formed through or within the inner edge 118. The spacer-securing features 120 may be formed through one or both of the upper and lower surfaces 110 and 112. The spacer-securing features 120 may provide alignment slots configured to align the membrane panel 100 with a membrane spacer. For example, the spacer-securing features 120 may be grooves linearly or irregularly spaced along the inner edges 118 of the brackets 104 and 106, while the membrane spacer includes protuberances, such as tabs, barbs, studs, or the like, that are configured to be received and retained within the spacer-securing features 120. Alternatively, the spacer-securing features 120 may be protuberances, while the membrane spacer includes the grooves, for example.

Figure 2:
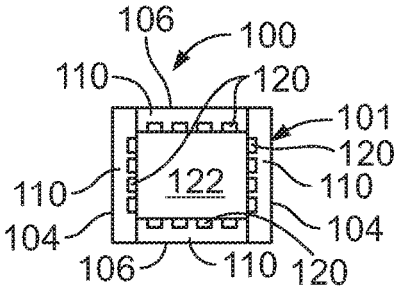
FIG. 2 illustrates a top plan view of an outer frame of a membrane panel, according to an embodiment of the present disclosure.

FIG. 2 illustrates a top plan view of the outer frame 101 of the membrane panel 100, according to an embodiment of the present disclosure. The membrane sheet 102 (shown in FIG. 1) is not shown in FIG. 2. As shown in FIG. 1, the outer frame 101 defines an opening 122 into which the membrane sheet 102 is secured. Terminal ends 123 of the end brackets 104 overlay terminal ends 124 of the lateral brackets 106. The end brackets 104 may be secured to the lateral brackets 106 through fasteners, adhesives, bonding, and/or the like. For example, each bracket 104 and 106 may be separately positioned and secured to form the unitary outer frame 101. Alternatively, the outer frame 101 may be integrally molded and formed as shown such as through injection-molding, for example. That is, the outer frame 101 may be a unitary, integrally molded and form piece.

As shown in FIG. 1, in particular, the end brackets 104 are positioned over the lateral brackets 106 such that an air channel 126 is defined between inner edges 116 of the opposed lateral brackets 106, while an air channel 128 is defined between inner edges 116 of the opposed end brackets 104. The air channel 126 is configured to allow an air stream 130 to pass therethrough below the membrane sheet 102 (as shown in FIG. 1), while the air channel 128 is configured to allow an air stream 132 to pass therethrough above the membrane sheet 102. As shown, the outer frame 102 may be formed so that the air channels 126 and 128 are perpendicular to one another. For example, the air channel 128 may be aligned parallel to an X axis, while the air channel 126 may be aligned parallel with a Y axis, which is orthogonal to the X axis.

Referring again to FIG. 1, the membrane sheet 102 may be a thin, porous, semi-permeable membrane. The membrane sheet 102 may be formed of a microporous material. For example, the membrane sheet 102 may be formed of polytetrafluoroethylene (PTFE), polypropylene (PP), nylon, polyvinylidene fluoride (PVDF), polyethersulfone (PES), or the like. The membrane sheet 102 may be hydrophilic or hydrophobic. The membrane sheet 102 may have the same length and width (for example, the same dimensions in at least one plane) as the outer frame 101. For example, the membrane sheet 102 may include a thin, moisture/vapor-promoting polymer film that is coated on a porous polymer substrate. In another example, the membrane sheet 102 may include a hygroscopic coating that is bonded to a resin or paper-like substrate material.

Alternatively, the membrane sheet 102 may not be porous. For example, the membrane sheet 102 may be formed of a non-porous plastic sheet that is configured to transfer heat, but not moisture, therethrough.

During assembly of the membrane panel 100, the membrane sheet 102 may be integrally formed and/or molded with the outer frame 101. For example, the membrane sheet 102 may be integrated and/or integrally formed with the frame 101 through a process of injection-molding. For example, an injection mold may be sized and shaped to form the membrane panel 100. Membrane material may be positioned within the mold and panel material, such as plastic, may be injected into the mold on and/or around portions of the membrane material to form the integral membrane panel 100. Alternatively, the membrane material may be injected into the mold, as opposed to a membrane sheet being positioned within the mold. In such embodiments, the membrane sheet 102 may be integrally formed and molded with the plastic of the outer frame 101. In at least one embodiment, the material that forms the outer frame 101 may also form the membrane sheet 102.

As an example, the membrane sheet 102 may be positioned within a mold that is configured to form the membrane panel 100. Hot, liquid plastic is injected into the mold and flows on and/or around portions of the membrane sheet 102. As the plastic cools and hardens to form the outer frame 101, the plastic securely fixes to edge portions of the membrane sheet 102. For example, during the injection molding, the hot, liquid plastic may melt into the membrane sheet 102, thereby securely fastening the outer frame 101 to the membrane sheet 102.

Accordingly, the membrane panel 100, including the membrane sheet 102 and the outer frame 101, may be formed in a single step, thereby providing an efficient assembly process.

Alternatively, the membrane sheet 102 may be integrated and/or integrally formed with the outer frame 101 through heat-sealing, ultrasonic bonding or welding, laser-bonding, or the like. For example, when the membrane panel 100 is formed through ultrasonic welding, ultrasonic vibrational energy may be focused into a specific interface area between the membrane sheet 102 and the outer frame 101, thereby securely welding, bonding, or otherwise securely connecting the membrane sheet 102 to the outer frame 101. In at least one embodiment, a ridge may extend over and/or around the outer frame 101. The membrane sheet 102 may be positioned on the outer frame 101, and the ultrasonic energy may be focused into the interface between the membrane sheet 102 and the ridge.

In at least one other embodiment, laser-bonding may be used to integrate the membrane sheet 102 into the outer frame 101. For example, a laser may be used to melt portions of the membrane sheet 102 into portions of the outer frame 101, or vice versa. The heat of the laser melts the membrane sheet 102 and/or the outer frame 101 to one another, thereby providing a secure connection therebetween. Alternatively, thermal plate bonding may be used to melt portions of the membrane sheet 102 and the outer frame 101 together.

The membrane sheet 102 may be integrally secured to lower surfaces 112 of the end brackets 104 and upper surfaces 110 of the lateral brackets 106, or vice versa. Once integrated with the outer frame 102, the membrane sheet 102 spans over and/or through the entire area of the opening 122 (shown in FIG. 2), and the membrane sheet 102 is sealed to the outer frame 102 along the entire perimeter defined by the lower surfaces 112 of the end brackets 104 and the upper surfaces 110 of the lateral brackets 106. Therefore, the membrane sheet 102 may be integrated or integrally formed with the outer frame 101 without using any adhesives (such as glues, tapes, or the like) or wrapping techniques. Embodiments of the present disclosure provide membrane panels having integrated or integral membrane sheets secured to outer frames without adhesives.

Optionally, the membrane panel 100 may include a sealing layer 140, which may be formed of a compressible material, such as foam. Alternatively, the sealing layer 140 may be a sealing gasket, for example. Also, alternatively, the sealing layer 140 may be a silicone or an adhesive. In at least one embodiment, the sealing layer 140 may include two strips 142 of sealant located along opposing frame segments, such as the end brackets 104.

Figure 3:
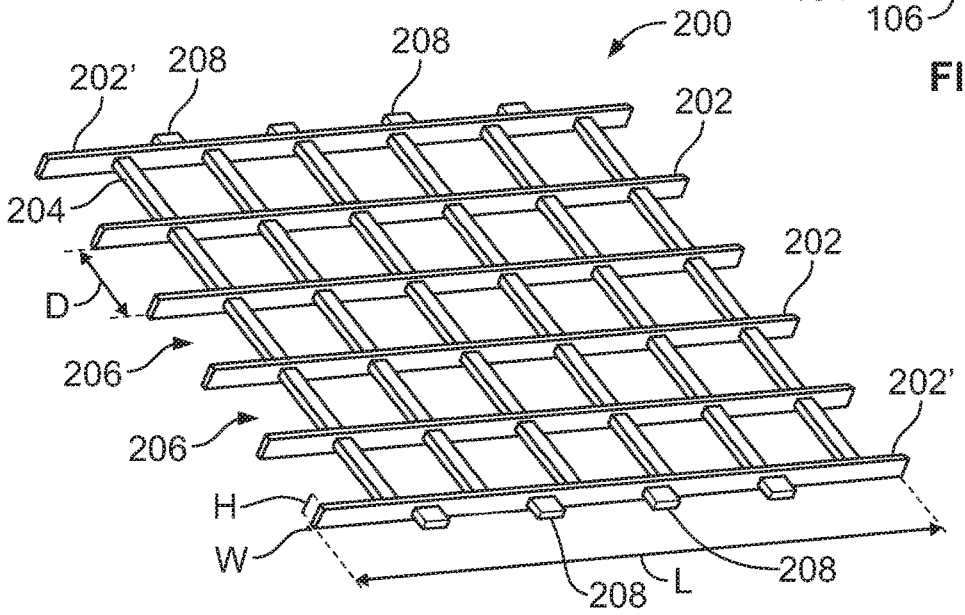
FIG. 3 illustrates a perspective top view of a membrane spacer, according to an embodiment of the present disclosure.

FIG. 3 illustrates a perspective top view of a membrane or air spacer 200, according to an embodiment of the present disclosure. The spacer 200 may be used with the membrane panel 100 shown in FIG. 1. The spacer 200 may be formed as a rectangular grid of rails 202 and reinforcing beams 204. For example, the rails 202 may each extend along the entire length L of the spacer 200, and the reinforcing beams 204 may fix each rail 202 to the adjacent rails 202. As shown in FIG. 3, the reinforcing beams 204 may be oriented perpendicularly to the rails 202 to form a checkerboard grid pattern. Optionally, the height of the spacer 200 may be the height H of the rails 202. Thus, when the spacers 200 are placed between the panels 100 (shown in FIG. 1), the space between the panels 100 may be the height H. The rails 202 may be oriented such that the height H of each rail is greater than the width W, as shown in FIG. 3. The width W may less than a distance D between adjacent rails 202 in order to maximize air flow through the spacer 200. Air through the spacer 200 may be configured to flow through channels 206 located between the rails 202.

The spacer 200 may include alignment tabs 208 that extend outwardly along the length of the outermost rails 202'. The alignment tabs 208 may be configured to be received in the spacer-securing features 120 of the membrane panels 100 (shown in FIGS. 1 and 2) for proper alignment of the membrane panels 100 relative to the spacer 200. For example, the alignment tabs 208 may be configured to be received in the spacer-securing features 120, such as slot, divots, or the like, of the membrane panel 100 located above the spacer 200, the membrane panel 100 located below the spacer 200, or both.

Referring to FIGS. 1-3, various types of spacers other than shown in FIG. 3 may be used to space the membrane panels 100 from one another. For example, U.S. patent application Ser. No. 13/797,062, filed Mar. 12, 2013, entitled "Membrane Support Assembly for an Energy Exchanger," which is hereby incorporated by reference in its entirety, describes various types of membrane spacers or support assemblies that may be used in conjunction with the membrane panels described with respect to the present application.

Figure 4:
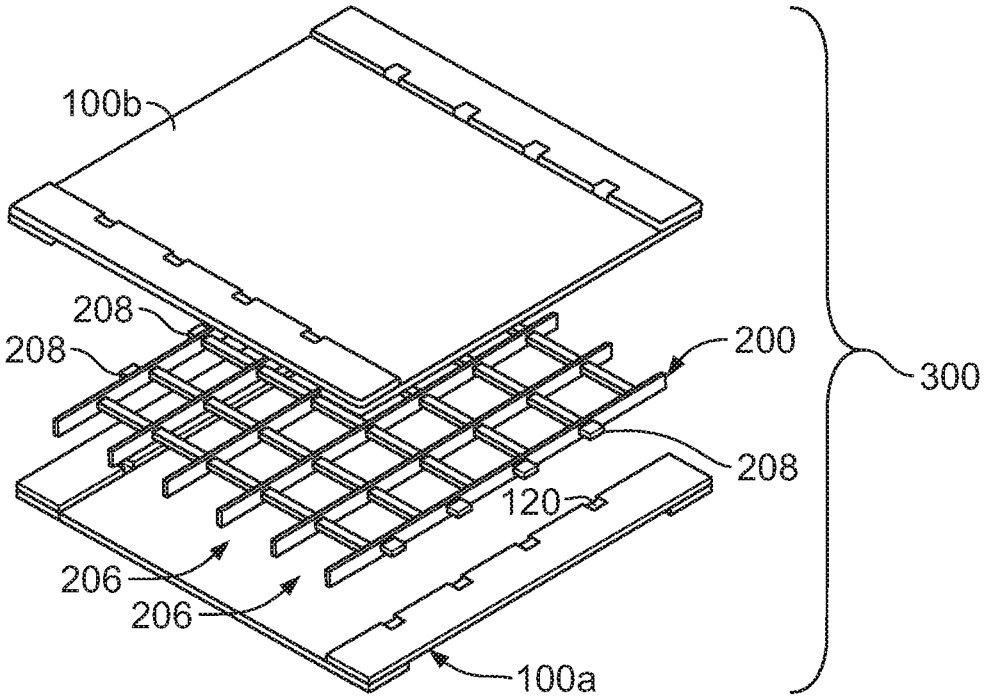
FIG. 4 illustrates a perspective exploded top view of a membrane stack, according to an embodiment of the present disclosure.

FIG. 4 illustrates a perspective exploded top view of a membrane stack 300, according to an embodiment of the present disclosure. The stack 300 may include an air or membrane spacer 200 between two panels 100. For example, an energy exchange assembly may be assembled by stacking alternating layers of panels 100 and spacers 200 into the stack 300. As shown, the spacer 200 may be mounted on top of a lower panel **100*a*, such that the alignment tabs 208 are received and retained in the spacer-securing features 120 of the panel 100*a*. Additional sealing between layers may be achieved with the sealing layer 140, which may be injection-molded or attached onto the outer frame 102**, for example.

An upper membrane panel **100*b* may be subsequently mounted on top of the spacer 200. Optionally, the upper membrane panel 100*b* may be rotated 90° with respect to the lower panel 100*a* upon mounting. Continuing the stacking pattern shown, an additional spacer (not shown) may be added above the upper panel 100*b* and aligns with the upper panel 100*b* such that a subsequent spacer may be rotated 90° relative to the spacer 200. Consequently, the channels 206 through the spacer 200 may be orthogonal to the channels (not shown) through the adjacent spacer, so that air flows through the channels 206 of the spacer 200 in a cross-flow direction relative to the air through the channels of the adjacent spacer. Alternatively, the membrane panels 100 and the spacers 200** may be arranged to support various fluid flow orientations, such as counter-flow, concurrent flow, and the like.

Figure 5:
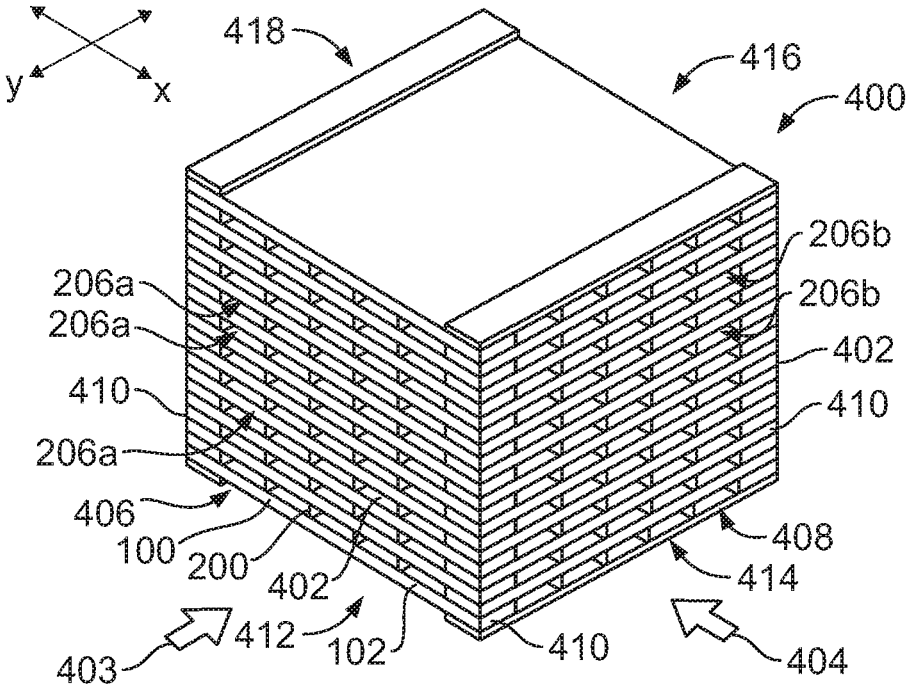
FIG. 5 illustrates a perspective top view of an energy exchange assembly, according to an embodiment of the present disclosure.

FIG. 5 illustrates a perspective top view of an energy exchange assembly 400, such as an energy recovery core, membrane heat exchanger, or the like, according to an embodiment of the present disclosure. The energy exchange assembly 400 may include a stack of multiple layers 402 of membrane panels 100 and spacers 200. As shown, the energy exchange assembly 400 may be a cross-flow, air-to-air membrane energy recovery core. During operation, a first fluid stream 403, such as air or other gas(es), enters the energy exchange assembly 400 through channels **206*a* defined within a first wall 406 of the assembly 400. The wall 406 may be defined, at least in part, by the outer edges of the outer frames 102 of the membrane panels 100 in the stack. Similarly, a second fluid stream 404, such as air or other gas(es), enters the assembly 400 through channels 206*b* defined within a second wall 408 of the assembly 400**.

The first fluid stream 403 direction may be perpendicular to the second fluid stream 404 direction through the assembly 400. As shown, the spacers 200 may be alternately positioned 90° relative to one another, so that the channels **206*b* are orthogonal to the channels 206*a*. Consequently, the fluid stream 403 through the assembly 400 is surrounded above and below by membrane sheets 102 (shown in FIG. 1, for example) that form borders separating the fluid stream 403 from the fluid stream 404, and vice versa. Thus, energy, in the form heat and/or humidity, may be exchanged through the membrane sheets 102** from the higher energy/temperature fluid flow to the lower energy/temperature fluid flow, for example.

The energy exchange assembly 400 may be oriented so that the fluid stream 403 may be outside air that is to be conditioned, while the second fluid stream 404 may be exhaust, return, or scavenger air that is used to condition the outside air before the outside air is supplied to downstream HVAC equipment and/or an enclosed space as supply air. Heat and moisture may be transferred between the first and second fluid streams 403 and 404 through the membrane sheets 102 (shown in FIG. 1, for example).

As shown, the membrane panels 100 may be secured between outer upstanding beams 410. As shown, the beams 410 may generally be at the corners of the energy exchange assembly 400. Alternatively, the energy exchange assembly 400 may not include the beams 410. Instead, the energy exchange assembly 400 may be formed through a stack of multiple membrane panels 100.

As an example of operation, the first fluid stream 403 may enter an inlet side 412 as cool, dry air. As the first fluid stream 403 passes through the energy exchange assembly 400, the temperature and humidity of the first fluid stream 403 are both increased through energy transfer with the second fluid stream 404 that enters the energy exchange assembly 400 through an inlet side 414 (that is perpendicular to the inlet side 412) as warm, moist air. Accordingly, the first fluid stream 403 passes out of an outlet side 416 as warmer, moister air (as compared to the first fluid stream 403 before passing into the inlet side 412), while the second fluid stream 404 passes out of an outlet side 418 as cooler, drier air (as compared to the second fluid stream 404 before passing into the inlet side 414). In general, the temperature and humidity of the first and second fluid streams 403 and 404 passing through the assembly 400 tends to equilibrate with one another. For example, warm, moist air within the assembly 400 is cooled and dried by heat exchange with cooler, drier air; while cool, dry air is warmed and moistened by the warmer, cooler air.

Figure 6:
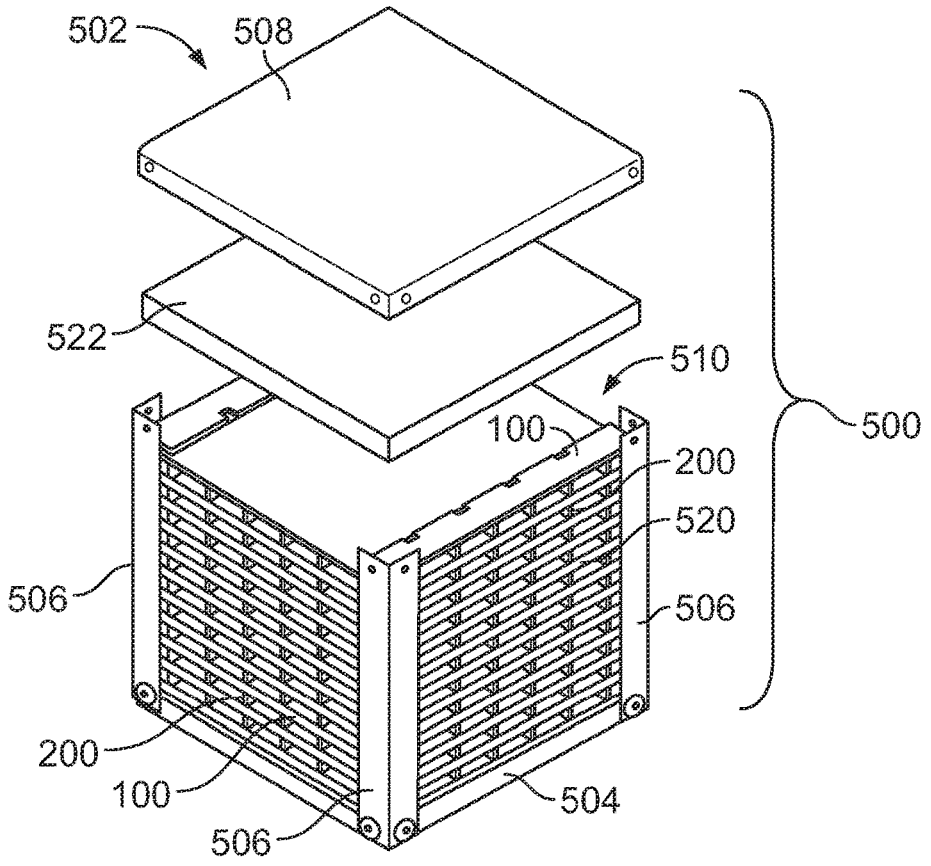
FIG. 6 illustrates a perspective top view of an outer casing being positioned on an energy exchange assembly, according to an embodiment of the present disclosure.
Figure 7:
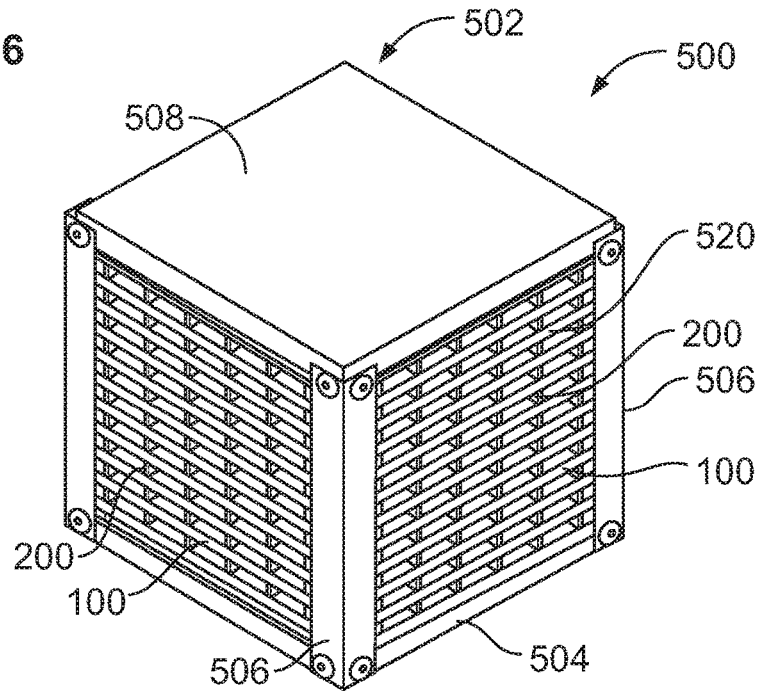
FIG. 7 illustrates a perspective top view of an energy exchange assembly having an outer casing, according to an embodiment of the present disclosure.

FIG. 6 illustrates a perspective top view of an outer casing 502 being positioned on an energy exchange assembly 500, according to an embodiment of the present disclosure. FIG. 7 illustrates a perspective top view of the energy exchange assembly 500 having the outer casing 502. The energy exchange assembly 500 may be as described above with respect to FIG. 5, for example. Referring to FIGS. 6 and 7, the casing 502 may include a base 504 connected to upstanding corner beams 506, which, in turn, connect to a cover 508. The base 504 may be secured to lower ends of the beams 506 through fasteners, for example, while the cover 508 may secure to upper ends of the beams 506 through fasteners, for example. The base 504, beams 506, and the cover 508 cooperate to define an internal chamber 510 into which the membrane panels 100 and the spacers 200 may be positioned.

The outer casing 502 may be formed of a metal (such as aluminum), plastic, or composite material. The outer casing 502 is configured to securely maintain the stack 520 in place to prevent misalignment. Upper and lower filler members 522 may be aligned vertically above and below the stack 520. The upper and lower filler members 522 may be mechanically attached to the cover 508 and the base 504, respectively, to prevent the stack 520 from movement in the vertical plane. The outer casing 502 may be riveted, screwed, bolted, or adhered together, for example. The filler members 506 may be foam layers (for example, polyurethane, Styrofoam, or the like) that compress the stack 520 under constant pressure.

Figure 8:
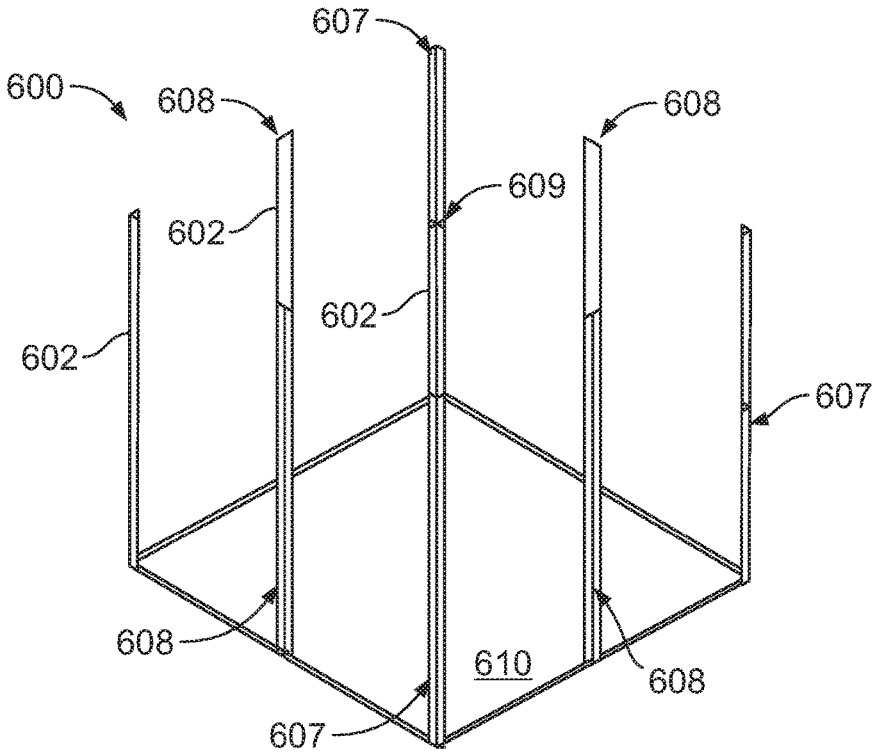
FIG. 8 illustrates a perspective top view of a stacking frame, according to an embodiment of the present disclosure.

FIG. 8 illustrates a perspective top view of a stacking frame 600, according to an embodiment of the present disclosure. The stacking frame 600 may be used in addition to, or instead of, the outer casing 502 (shown in FIGS. 6 and 7) to arrange multiple membrane stacks 400 in a stacked arrangement.

Figure 9:
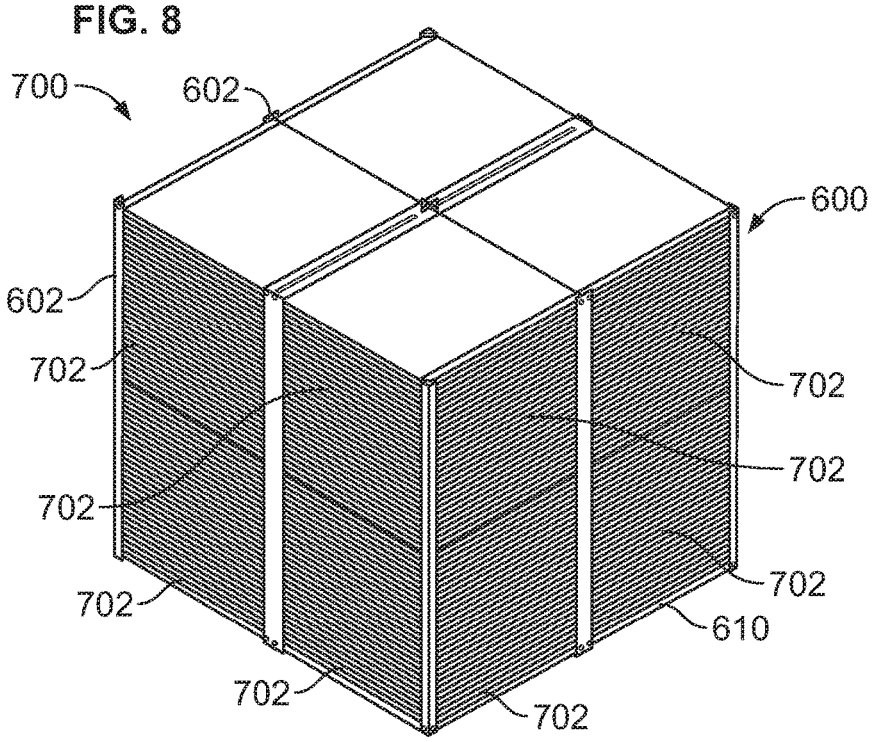
FIG. 9 illustrates a perspective top view of an energy exchange assembly having multiple membrane stacks secured within a stacking frame, according to an embodiment of the present disclosure.

FIG. 9 illustrates a perspective top view of an energy exchange assembly 700 having multiple membrane stacks 702 secured within the stacking frame 600, according to an embodiment of the present disclosure. As shown, the individual membrane stacks 702 may be stacked together in various arrangements to increase the size and to modify/customize the dimensions of the energy exchange assembly 700. Thus, instead of a manufacturer having to making several sized assemblies to fit into different HVAC units, modular stacks 702 may be used to form an assembly 700 of desired size. Modular membrane panels and/or membrane stacks 702 reduce part costs and the need for additional sizes of injection-molded parts.

Referring to FIGS. 8 and 9, each individual membrane stack 702 may be mounted on the stacking frame 600. The stacking frame 600 may be configured to mount eight or fewer membrane stacks 702 arranged in a cube, as shown in FIG. 9. However, the stacking frame 600 may be configured to mount more than eight membrane stacks 702. The stacking frame 600 may include multiple frame members 602 that retain the individual membrane stacks 702 within the assembly 700. The frame members 602 extend vertically from a base 610, and include corner angle members 607, T-angle members 608, and center cross members 609. While not shown, a top cover may be secured to upper ends of the frame members 602 over the membrane stacks 702.

The frame members 602 may be configured to keep the membrane stacks 702 separated. For example, the center cross member 609 and T-angle members 608 may separate adjacent vertical columns of membrane stacks 702. The stacking frame 600 may be formed of extruded aluminum, plastic, or like materials. Sealing between each membrane stack 400 and the frame members 602 may be achieved by lining each member 602 with a thin foam layer, which may compress as the stack is assembled to provide a retention force. Alternatively, or in addition, sealant or silicone may be used.

Figure 10:
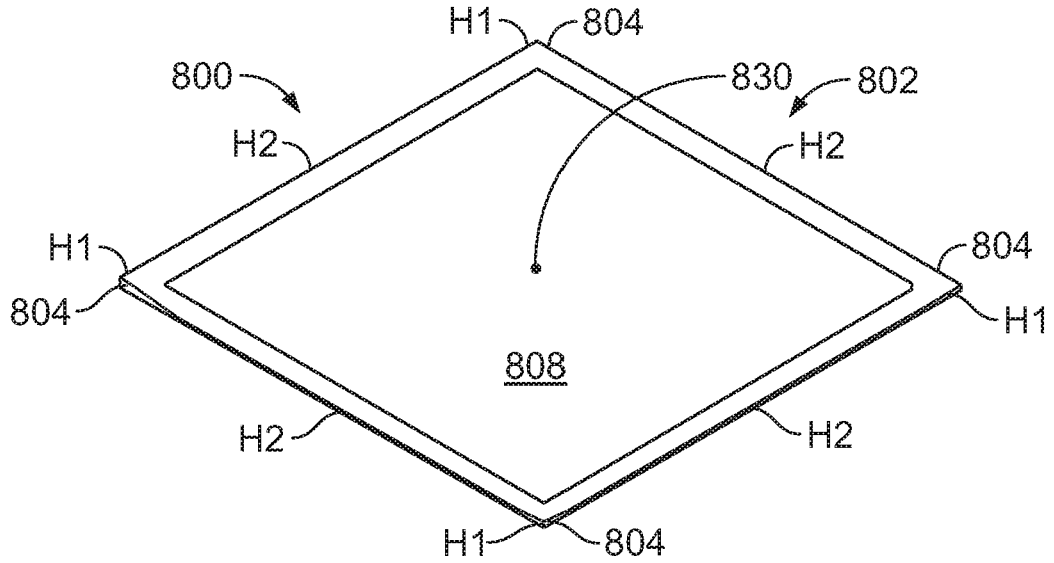
FIG. 10 illustrates a perspective top view of an outer frame of a membrane panel, according to an embodiment of the present disclosure.
Figure 11:
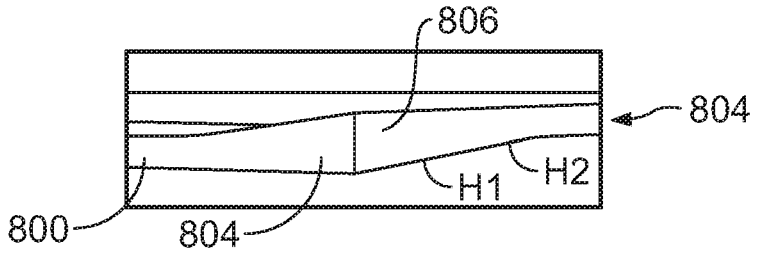
FIG. 11 illustrates a corner view of an outer frame of a membrane panel, according to an embodiment of the present disclosure.

FIG. 10 illustrates a perspective top view of an outer frame 800 of a membrane panel 802, according to an embodiment of the present disclosure. FIG. 11 illustrates a corner view of the outer frame 800 of the membrane panel 802. A membrane sheet is not shown in FIGS. 10 and 11. Referring to FIGS. 10 and 11, the outer frame 800 may be similar to the outer frame 101, shown in FIGS. 1 and 2, for example. However, the outer frame 800 may not have a uniform height throughout. Instead, the outer frame 800 may include corners 804 having a height H1 that is greater than a height H2 of the outer frame 800 between the corners 804. The height of the outer frame 800 may smoothly and evenly transition between the height H1 and the height H2. For example, the difference between the heights H1 and H2 may be formed by a sloping or arcuate segment 806 along the top and/or bottom of the outer frame 800. Additionally, the corners 804 may be sloped or curved to increase height in a radial outward direction from a center 830 of an opening 808, such that the greatest height is at each of the four outer corner edges, with the heights sloping downward towards the opening 808

Figure 12:
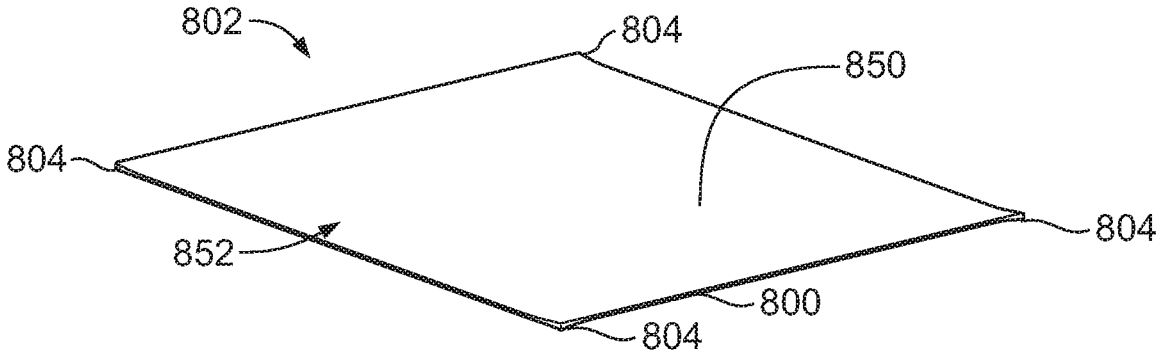
FIG. 12 illustrates a perspective top view of a membrane panel, according to an embodiment of the present disclosure.
Figure 13:
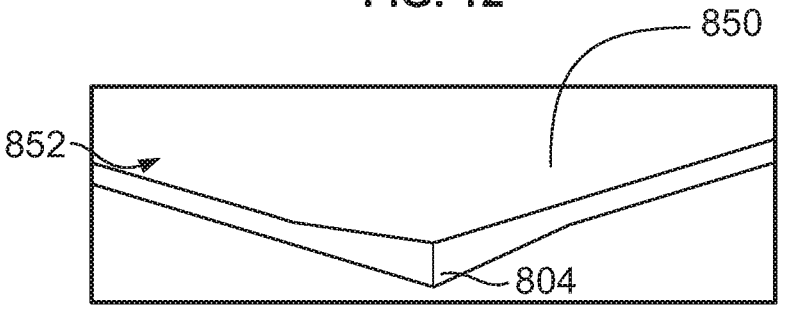
FIG. 13 illustrates a perspective top view of a membrane sheet secured to a corner of an outer frame of a membrane panel, according to an embodiment of the present disclosure.

FIG. 12 illustrates a perspective top view of the membrane panel 802, according to an embodiment of the present disclosure. FIG. 13 illustrates a perspective top view of a membrane sheet 850 secured to a corner 804 of the outer frame 800 of the membrane panel 802. Referring to FIGS. 12 and 13, the membrane sheet 850 may be secured to a top surface of the outer frame 800. Optionally, the membrane sheet 850 may be secured to a bottom surface of the outer frame 800. Also, optionally, a membrane sheet may be secured to the top surface of the outer frame 800, while another membrane sheet may be secured to the bottom surface of the outer frame 800. The sloped corners 804 slope the membrane sheet 850 downwardly between the corners 804. As such, fluid channels 852 may be defined between the corners 804.

The membrane sheet 850 may be integrated with the outer frame 800. For example, bottom edges of the membrane sheet 850 may be bonded, welded, or the like to the top surface of the outer frame 800. In contrast to the outer frame 101 shown in FIG. 1, an entirety of the outer frame 800 may be on one side of the membrane sheet 850, rather than on two sides. The sloped portions and corners allow for easier bonding, welding, or the like of the membrane sheet 850 to the outer frame 800.

Figure 14:
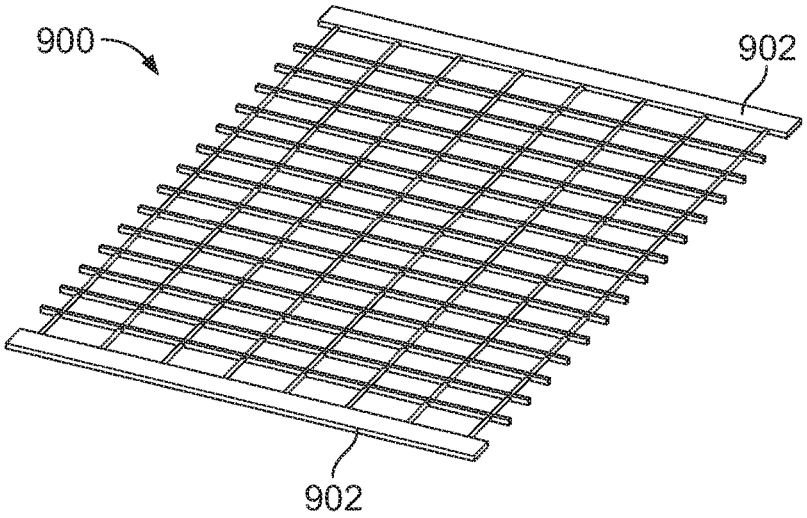
FIG. 14 illustrates a perspective top view of a membrane spacer, according to an embodiment of the present disclosure.
Figure 15:
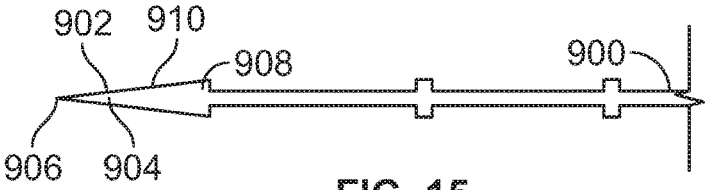
FIG. 15 illustrates a lateral view of a stacking connecting bracket of a membrane spacer, according to an embodiment of the present disclosure.

FIG. 14 illustrates a perspective top view of a membrane spacer 900, according to an embodiment of the present disclosure. FIG. 15 illustrates a lateral view of a stacking connecting bracket 902 of the membrane spacer 900. Referring to FIGS. 14 and 15, the membrane spacer 900 is similar to the membrane spacer 200 (shown in FIG. 3), except that that connecting bracket 902 is configured to stack between corners of upper and lower membrane panels 802 (shown in FIGS. 12 and 13). As such, the contour of the connecting bracket 902 may be a reciprocal shape to the corners 804 (shown in FIGS. 12 and 13). For example, the connecting bracket 902 may include a beveled end 904 having a thin distal tip 906 that connects to an expanded base 908 through a sloped surface 910. The thin distal tip 906 is configured to be positioned on top of or below the high distal corners 804, while the expanded base 908 is positioned on or below downwardly sloped portions of the corners 804. As such, the membrane spacer 900 is configured to lay flat over the membrane panel 802 shown in FIGS. 12 and 13.

As shown, the connecting brackets 902 may include a triangular cross-section (when viewed in cross-section along the profile) on each end to fit against the outer frame 800. Alternatively, the connecting brackets 902 may have other than triangular cross-sectional shapes, depending on the size and shape of the outer frame 800. In at least one embodiment, a thin foam may be added to one side, through either injection-molding or bonding, or an adhesive or sealant may be used to provide sealing between the connecting brackets 902 and the outer frame 800. Additional alignment features (not shown) may be added to both the outer frame 800 and/or the membrane spacer 900 to ensure proper alignment of each layer within a membrane stack.

Figure 16:
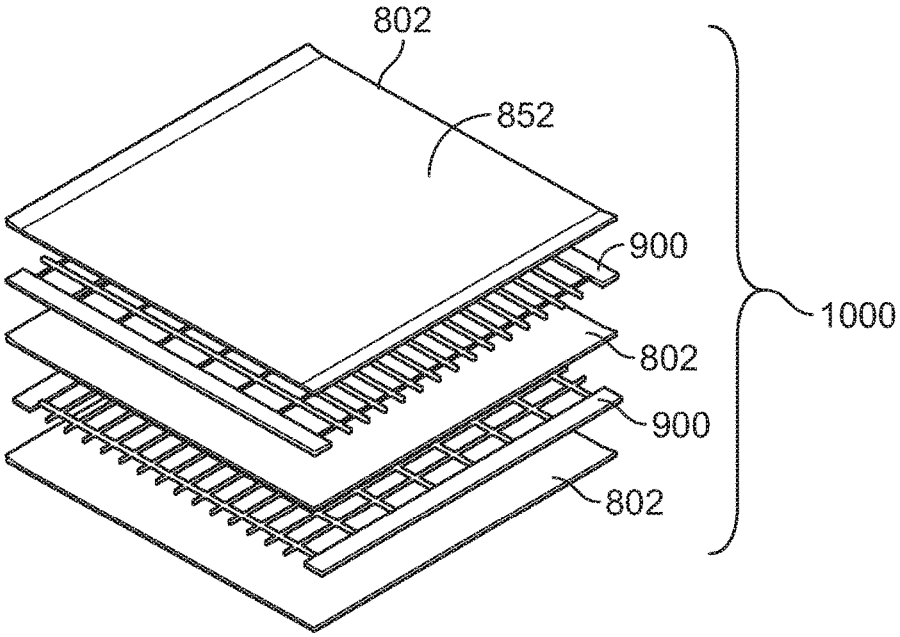
FIG. 16 illustrates a perspective exploded top view of a membrane stack, according to an embodiment of the present disclosure.

FIG. 16 illustrates a perspective exploded top view of a membrane stack 1000, according to an embodiment of the present disclosure. Referring to FIGS. 12-16, the stack 1000 may include alternating layers of the membrane spacers 900 and the membrane panels 802. Each membrane panel 802 may include an outer frame 800 having an integrated membrane sheet 852.

Figure 17:
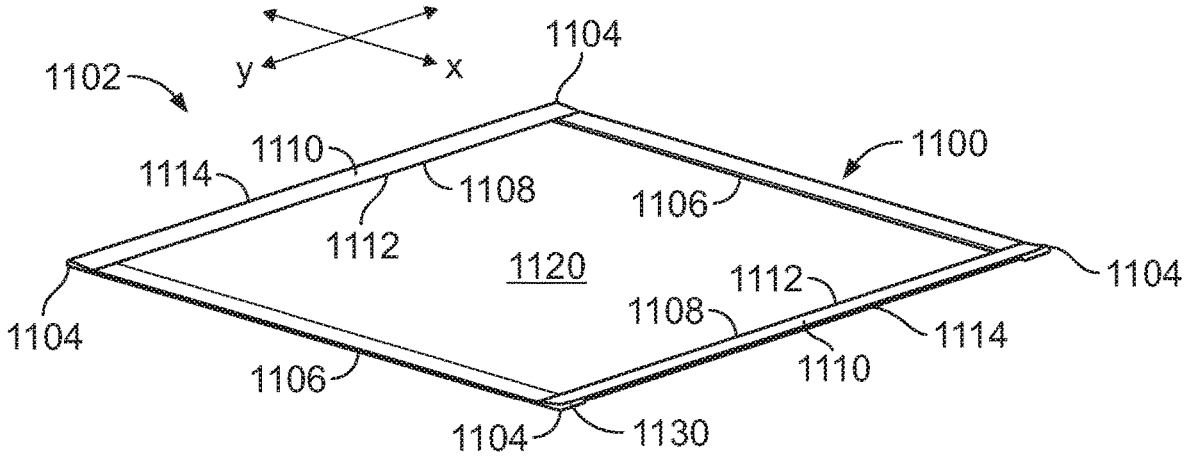
FIG. 17 illustrates a perspective top view of an outer frame of a membrane panel, according to an embodiment of the present disclosure.
Figure 18:
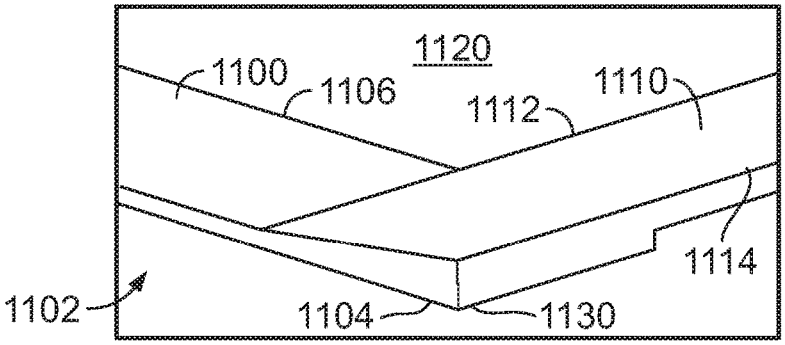
FIG. 18 illustrates a perspective top view of a corner of an outer frame of a membrane panel, according to an embodiment of the present disclosure.

FIG. 17 illustrates a perspective top view of an outer frame 1100 of a membrane panel 1102, according to an embodiment of the present disclosure. FIG. 18 illustrates a perspective top view of a corner 1104 of the outer frame 1100 of the membrane panel 1102. The outer frame 1100 is similar to the outer frame 800 shown in FIGS. 10 and 11, for example. The outer frame 1100 includes two opposed planar brackets 1106 that are parallel with the X axis, and two opposed sloped brackets 1108 that are parallel with the Y axis. The brackets 1106 may be secured to the brackets 1108 through fasteners, bonding, welding, or the like. Optionally, the outer frame 110 may be integrally molded and formed as a single piece, such as through injection-molding. Each sloped bracket 1108 includes a sloped surface 1110 that slopes upwardly from a thin inner edge 1112 to an expanded outer edge 1114 such that the height of the inner edge 1112 is less than the height of the expanded outer edge 1114. The sloped surface 1110 slopes upwardly from an opening 1120 to the distal outer edge 1114. The slope of the sloped surface 1110 may be even and gradual, and may generally be sized and shaped to conform to a reciprocally-shaped connecting bracket of a membrane spacer. The outer frame 1100 may also include an alignment member 1130, such as a post, shoulder, column, block, or the like, downwardly extending from a bottom surface of the corner 1104. The alignment member 1130 may be used to align the membrane panel 1102 during stacking.

Figure 19:
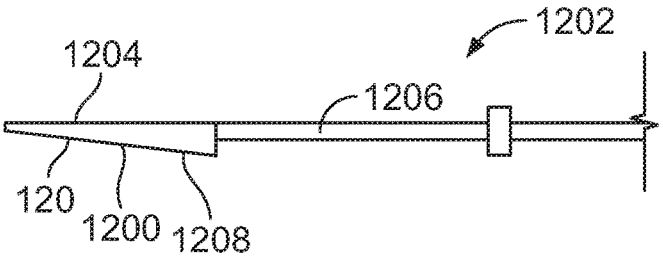
FIG. 19 illustrates a lateral view of a stacking connecting bracket of a membrane spacer, according to an embodiment of the present disclosure.

FIG. 19 illustrates a lateral view of a stacking connecting bracket 1200 of a membrane spacer 1202, according to an embodiment of the present disclosure. The membrane spacer 1202 is similar to the membrane spacer 900 shown in FIGS. 14 and 15, except that that the connecting bracket 1200 is configured to overlay or otherwise connect to the sloped bracket 1108, shown in FIGS. 17 and 18. The cross-sectional profile of the connecting bracket 1200 may have one side 1204 that is coplanar with a top surface of a beam 1206, and an opposite side 1208 that is sloped in a reciprocal fashion with respect to the slope of the sloped bracket 1108. As shown, the profile of the connecting bracket 1200 may be a right triangle. Optionally, the profile may be formed having various other shapes and sizes, depending on the size and shape of the outer frame to which the connecting bracket 1200 secures.

Any of the outer frames and the membrane spacers described above may be formed as individual pieces, or integrally formed together as a single piece (such as through injection molding).

Figure 20:
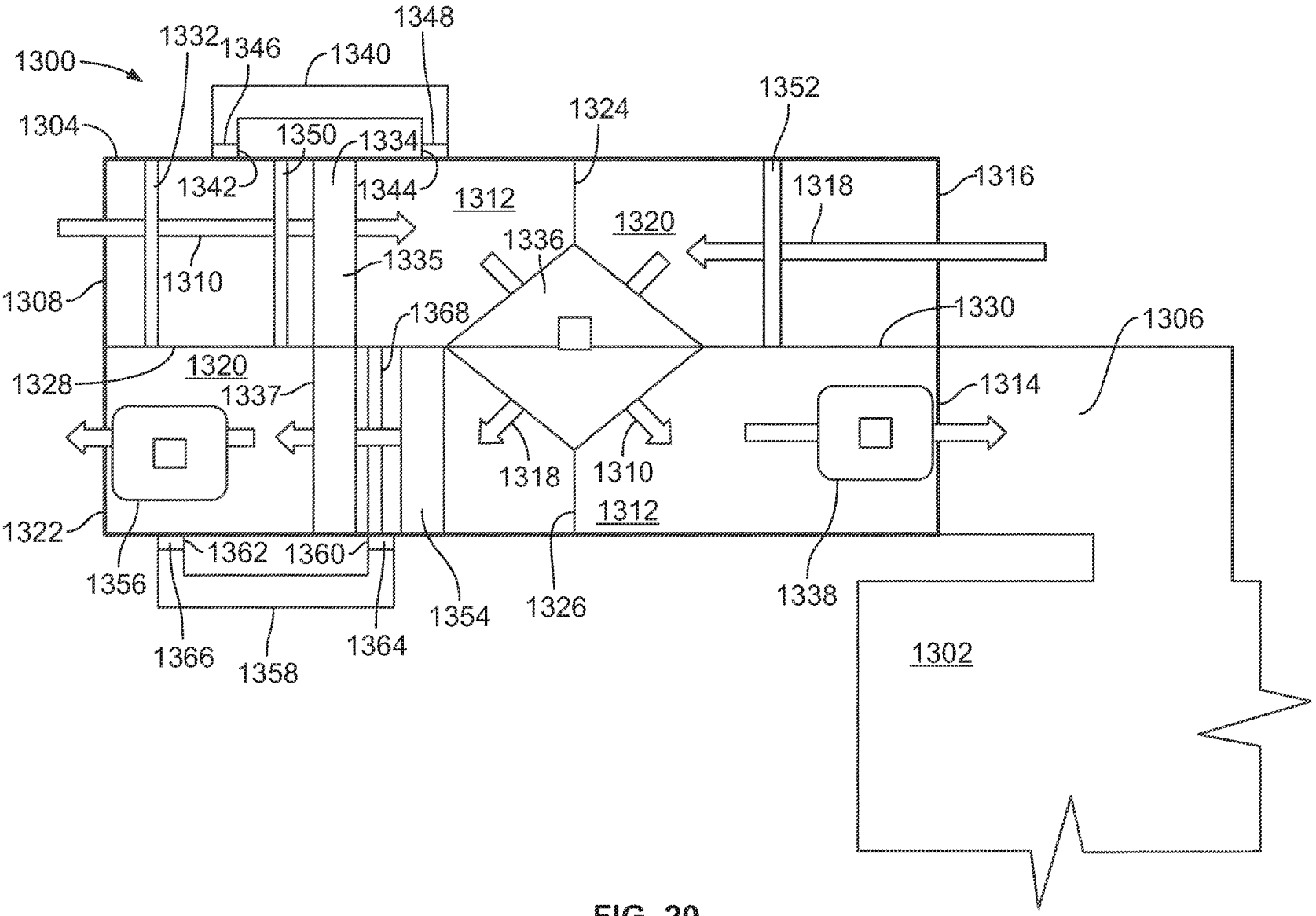
FIG. 20 illustrates a simplified schematic view of an energy exchange system operatively connected to an enclosed structure, according to an embodiment of the present disclosure.

FIG. 20 illustrates a simplified schematic view of an energy exchange system 1300 operatively connected to an enclosed structure 1302, according to an embodiment of the present disclosure. The energy exchange system 1300 may include a housing 1304, such as a self-contained module or unit that may be mobile (for example, the housing 1304 may be moved among a plurality of enclosed structures), operatively connected to the enclosed structure 1302, such as through a connection line 1306, such as a duct, tube, pipe, conduit, plenum, or the like. The housing 1304 may be configured to be removably connected to the enclosed structure 1302. Alternatively, the housing 1304 may be permanently secured to the enclosed structure 1302. As an example, the housing 1304 may be mounted to a roof, outer wall, or the like, of the enclosed structure 1302. The enclosed structure 1302 may be a room of a building, a storage structure (such as a grain silo), or the like.

The housing 1304 includes a supply air inlet 1308 that connects to a supply air flow path 1310. The supply air flow path 1310 may be formed by ducts, conduits, plenum, channels, tubes, or the like, which may be formed by metal and/or plastic walls. The supply air flow path 1310 is configured to deliver supply air 1312 to the enclosed structure 1302 through a supply air outlet 1314 that connects to the connection line 1306.

The housing 1304 also includes a regeneration air inlet 1316 that connects to a regeneration air flow path 1318. The regeneration air flow path 1318 may be formed by ducts, conduits, plenum, tubes, or the like, which may be formed by metal and/or plastic walls. The regeneration air flow path 1318 is configured to channel regeneration air 1320 received from the atmosphere (for example, outside air) back to the atmosphere through an exhaust air outlet 3122.

As shown in FIG. 20, the supply air inlet 1308 and the regeneration air inlet 1316 may be longitudinally aligned. For example, the supply air inlet 1308 and the regeneration air inlet 1316 may be at opposite ends of a linear column or row of ductwork. A separating wall 1324 may separate the supply air flow path 1310 from the regeneration air flow path 1318 within the column or row. Similarly, the supply air outlet 1314 and the exhaust air outlet 1322 may be longitudinally aligned. For example, the supply air outlet 1314 and the exhaust air outlet 1322 may be at opposite ends of a linear column or row of ductwork. A separating wall 1326 may separate the supply air flow path 1310 from the regeneration air flow path 1318 within the column or row.

The supply air inlet 1308 may be positioned above the exhaust air outlet 1322, and the supply air flow path 1310 may be separated from the regeneration air flow path 1318 by a partition 1328. Similarly, the regeneration air inlet 1316 may be positioned above the supply air outlet 1314, and the supply air flow path 1310 may be separated from the regeneration air flow path 1318 by a partition 1330. Thus, the supply air flow path 1310 and the regeneration air flow path 1318 may cross one another proximate to a center of the housing 1304. While the supply air inlet 1308 may be at the top and left of the housing 1304 (as shown in FIG. 20), the supply air outlet 1314 may be at the bottom and right of the housing 1304 (as shown in FIG. 20). Further, while the regeneration air inlet 1316 may be at the top and right of the housing 1304 (as shown in FIG. 20), the exhaust air outlet 1322 may be at the bottom and left of the housing 1304 (as shown in FIG. 20).

Alternatively, the supply air flow path 1310 and the regeneration air flow path 1318 may be inverted and/or otherwise re-positioned. For example, the exhaust air outlet 1322 may be positioned above the supply air inlet 1308. Additionally, alternatively, the supply air flow path 1310 and the regeneration air flow path 1318 may be separated from one another by more than the separating walls 1324 and 1326 and the partitions 1328 and 1330 within the housing 1304. For example, spaces, which may contain insulation, may also be positioned between segments of the supply air flow path 1310 and the regeneration air flow path 1318. Also, alternatively, the supply air flow path 1310 and the regeneration air flow path 3118 may simply be straight, linear segments that do not cross one another. Further, instead of being stacked, the housing 1304 may be shifted 180 degrees about a longitudinal axis aligned with the partitions 1328 and 1330, such that that supply air flow path 1310 and the regeneration air flow path 1318 are side-by-side, instead of one on top of another.

An air filter 1332 may be disposed within the supply air flow path 1310 proximate to the supply air inlet 1308. The air filter 1332 may be a standard HVAC filter configured to filter contaminants from the supply air 1312. Alternatively, the energy exchange system 1300 may not include the air filter 1332.

An energy transfer device 1334 may be positioned within the supply air flow path 1310 downstream from the supply air inlet 1308. The energy transfer device 1334 may span between the supply air flow path 1310 and the regeneration air flow path 1318. For example, a supply portion or side 1335 of the energy transfer device 1334 may be within the supply air flow path 1310, while a regenerating portion or side 1337 of the energy transfer device 1334 may be within the regeneration air flow path 1318. The energy transfer device 1334 may be a desiccant wheel, for example. However, the energy transfer device 1334 may be various other systems and assemblies, such as including liquid-to-air membrane energy exchangers (LAMEEs), as described below.

An energy exchange assembly 1336, such as described above with respect to FIGS. 1-19, is disposed within the supply air flow path 1310 downstream from the energy transfer device 1334. The energy exchange assembly 1336 may be positioned at the junction of the separating walls 1324, 1326 and the partitions 1328, 1330. The energy exchange assembly 1336 may be positioned within both the supply air flow path 1310 and the regeneration air flow path 1318. As such, the energy exchange assembly 1336 is configured to transfer energy between the supply air 1312 and the regeneration air 1320.

One or more fans 1338 may be positioned within the supply air flow path 1310 downstream from the energy exchange assembly 1336. The fan(s) 1338 is configured to move the supply air 1312 from the supply air inlet 1308 and out through the supply air outlet 1314 (and ultimately into the enclosed structure 1302). Alternatively, the fan(s) 1338 may be located at various other areas of the supply air flow path 1310, such as proximate to the supply air inlet 1308. Also, alternatively, the energy exchange system 1300 may not include the fan(s).

The energy exchange system 1300 may also include a bypass duct 1340 having an inlet end 1342 upstream from the energy transfer device 1334 within the supply air flow path 1310. The inlet end 1342 connects to an outlet end 1344 that is downstream from the energy transfer device 1334 within the supply air flow path 1310. An inlet damper 1346 may be positioned at the inlet end 1342, while an outlet damper 1348 may be positioned at the outlet end 1344. The dampers 1346 and 1348 may be actuated between open and closed positions to provide a bypass line for the supply air 1312 to bypass around the energy transfer device 1334. Further, a damper 1350 may be disposed within the supply air flow path 1310 downstream from the inlet end 1342 and upstream from the energy transfer device 1334. The damper 1350 may be closed in order to allow the supply air 1312 to flow into the bypass duct 1340 around the energy transfer device 1334. The dampers 1346, 1348, and 1350 may be modulated between fully-open and fully-closed positions to allow a portion of the supply air 1312 to pass through the energy transfer device 1334 and a remaining portion of the supply air 1312 to bypass the energy transfer device 1334. As such, the bypass dampers 1346, 1348, and 1350 may be operated to control the temperature and humidity of the supply air 1312 as it is delivered to the enclosed structure 1302. Examples of bypass ducts and dampers are further described in U.S. patent application Ser. No. 13/426,793, which was filed Mar. 22, 2012, and is hereby incorporated by reference in its entirety. Alternatively, the energy exchange system 1300 may not include the bypass duct 1340 and dampers 1346, 1348, and 1350.

As shown in FIG. 20, the supply air 1312 enters the supply air flow path 1310 through the supply air inlet 1308.

The supply air 1312 is then channeled through the energy transfer device 1334, which pre-conditions the supply air 1312. After passing through the energy transfer device 1334, the supply air 1312 is pre-conditioned and passes through the energy exchange assembly 1336, which conditions the pre-conditioned supply air 1312. The fan(s) 1338 may then move the supply air 1312, which has been conditioned by the energy exchange assembly 1336, through the energy exchange assembly 1336 and into the enclosed structure 1302 through the supply air outlet 1314.

With respect to the regeneration air flow path 1318, an air filter 1352 may be disposed within the regeneration air flow path 1318 proximate to the regeneration air inlet 1316. The air filter 1352 may be a standard HVAC filter configured to filter contaminants from the regeneration air 1320, Alternatively, the energy exchange system 1300 may not include the air filter 1352.

The energy exchange assembly 1336 may be disposed within the regeneration air flow path 1318 downstream from the air filter 1352. The energy exchange assembly 1336 may be positioned within both the supply air flow path 1310 and the regeneration air flow path 1318. As such, the energy exchange assembly 1336 is configured to transfer sensible energy and latent energy between the regeneration air 1320 and the supply air 1312.

A heater 1354 may be disposed within the regeneration air flow path 1318 downstream from the energy exchange assembly 1336. The heater 1354 may be a natural gas, propane, or electric heater that is configured to heat the regeneration air 1320 before it encounters the energy transfer device 1334. Optionally, the energy exchange system 1300 may not include the heater 1354.

The energy transfer device 1334 is positioned within the regeneration air flow path 1318 downstream from the heater 1354. As noted, the energy transfer device 1334 may span between the regeneration air flow path 1318 and the supply air flow path 1310.

As shown in FIG. 20, the supply side 1335 of the energy transfer device 1334 is disposed within the supply air flow path 1310 proximate to the supply air inlet 1308, while the regeneration side 1337 of the energy transfer device 1334 is disposed within the regeneration air flow path 1310 proximate to the exhaust air outlet 1322. Accordingly, the supply air 3112 encounters the supply side 1335 as the supply air 1312 enters the supply air flow path 1310 from the outside, while the regeneration air 1320 encounters the regeneration side 1337 just before the regeneration air 1320 is exhausted out of the regeneration air flow path 1318 through the exhaust air outlet 1322.

One or more fans 1356 may be positioned within the regeneration air flow path 1318 downstream from the energy transfer device 1334. The fan(s) 1356 is configured to move the regeneration air 1320 from the regeneration air inlet 1316 and out through the exhaust air outlet 1322 (and ultimately into the atmosphere). Alternatively, the fan(s) 1356 may be located at various other areas of the regeneration air flow path 1318, such as proximate to the regeneration air inlet 1316. Also, alternatively, the energy exchange system 1300 may not include the fan(s).

The energy exchange system 1300 may also include a bypass duct 1358 having an inlet end 1360 upstream from the energy transfer device 1334 within the regeneration air flow path 1318. The inlet end 1360 connects to an outlet end 1362 that is downstream from the energy transfer device 1334 within the regeneration air flow path 1318. An inlet damper 1364 may be positioned at the inlet end 1360, while an outlet damper 1366 may be positioned at the outlet end 1362. The dampers 1364 and 1366 may be actuated between open and closed positions to provide a bypass line for the regeneration air 1320 to flow around the energy transfer device 1334. Further, a damper 1368 may be disposed within the regeneration air flow path 1318 downstream from the heater 1354 and upstream from the energy transfer device 334. The damper 1368 may be closed in order to allow the regeneration air to bypass into the bypass duct 1358 around the energy transfer device 1334. The dampers 1364, 1366, and 1368 may be modulated between fully-open and fully-closed positions to allow a portion of the regeneration air 1320 to pass through the energy transfer device 1334 and a remaining portion of the regeneration air 1320 to bypass the energy transfer device 1334. Alternatively, the energy exchange system 1300 may not include the bypass duct 1358 and dampers 1364 and 1366.

As shown in FIG. 20, the regeneration air 1320 enters the regeneration air flow path 1318 through the regeneration air inlet 1316. The regeneration air 1320 is then channeled through the energy exchange assembly 1336. After passing through the energy exchange assembly 1336, the regeneration air 1320 passes through the heater 1354, where it is heated, before encountering the energy transfer device 1334. The fan(s) 1356 may then move the regeneration air 1320 through the energy transfer device 1334 and into the atmosphere through the exhaust air outlet 1322.

As described above, the energy exchange assembly 1336 may be used with respect to the energy exchange system 300. Optionally, the energy exchange assembly 1336 may be used with various other systems that are configured to condition outside air and supply the conditioned air as supply air to an enclosed structure, for example. The energy exchange assembly 1336 may be positioned within a supply air flow path, such as the path 1310, and a regeneration or exhaust air flow path, such as the path 1318, of a housing, such as the housing 1304. The energy exchange system 1300 may include only the energy exchange assembly 1336 within the paths 1310 and 1318 of the housing 1304, or may alternatively include any of the additional components shown and described with respect to FIG. 20.

Referring to FIGS. 1-20, embodiments of the present disclosure provide membrane panels that include an outer frame that is integrated or integrally formed with a membrane sheet. The membrane sheet may be inserted into a mold and material, such as plastic, that forms the outer frame may be injection-molded onto or around portions of the membrane sheet. In other embodiments, the membrane sheet may be ultrasonically welded to the outer frame. In other embodiments, the membrane sheet may be secured to the outer frame, such as through portions being melted through lasers, for example.

Figure 21:
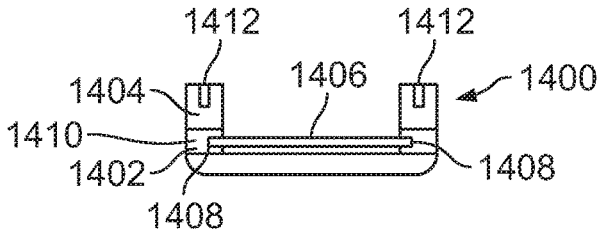
FIG. 21 illustrates a simplified cross-sectional view of a mold configured to form a membrane panel, according to an embodiment of the present disclosure.

FIG. 21 illustrates a simplified cross-sectional view of a mold 1400 configured to form a membrane panel 1402, according to an embodiment of the present disclosure. The mold 1400 includes an internal chamber 1404 that is configured to receive liquid plastic, for example. A membrane sheet 1406 may be suspended within portions of the mold 1400 so that outer edges 1408 extend into the internal chamber 1404. Hot, liquid plastic 1410 is injected into the internal chamber 1404 through one or more inlets 1412. The liquid plastic 1410 flows around the outer edges 1408, As the liquid plastic 1410 cools and hardens to form the outer frame, the plastic securely fixes to the outer edges 1408. In this manner, the membrane sheet 1406 may be integrally formed with the outer frame. The formed membrane panel 1402 may then be removed from the mold 1400.

Figure 22:
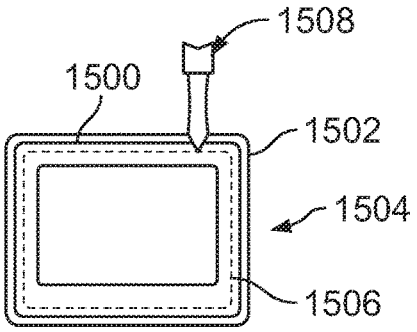
FIG. 22 illustrates a simplified representation of a membrane sheet being integrated with an outer frame of a membrane panel, according to an embodiment of the present disclosure.

FIG. 22 illustrates a simplified representation of a membrane sheet 1500 being integrated with an outer frame 1502 of a membrane panel 1504, according to an embodiment of the present disclosure. The outer frame 1502 may include an upstanding ridge 1506. The ridge 1506 may provide an energy director that is used to create a robust bond between the outer frame 1502 and the membrane sheet 1500. The ridge 1506 may be a small profile on the outer frame 1502 that is configured to direct and focus emitted energy thereto. An energy-emitting device 1508, such as an ultrasonic welder, laser, or the like, emits focused energy, such as ultrasonic energy, a laser beam, or the like, into the membrane sheet 1500 over the ridge 1506. The emitted energy securely bonds the outer frame 1502 to the ridge 1506, such as by melting portions of the membrane sheet 1500 to the ridge 1506, or vice versa. In this manner, the membrane sheet 1500 may be integrally formed with the outer frame 1502. Alternatively, the outer frame 1502 may not include the ridge 1506.

Figure 23:
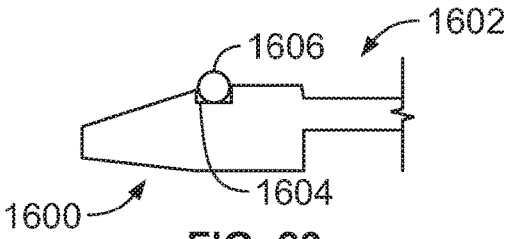
FIG. 23 illustrates a lateral view of a connecting bracket of a membrane spacer, according to an embodiment of the present disclosure.

FIG. 23 illustrates a lateral view of a connecting bracket 1600 of a membrane spacer 1602, according to an embodiment of the present disclosure. A channel 1604 may be formed in the connecting bracket 1600. The channel 1604 may retain a gasket 1606, which may be used to provide a sealing interface between the connecting bracket 1600 and a membrane panel. The channel 1604 and the gasket 1606 may be used with respect to any of the membrane spacers described above, such as those shown in FIGS. 3, 14, 15, 17, 18, and 19, for example.

Figure 24:
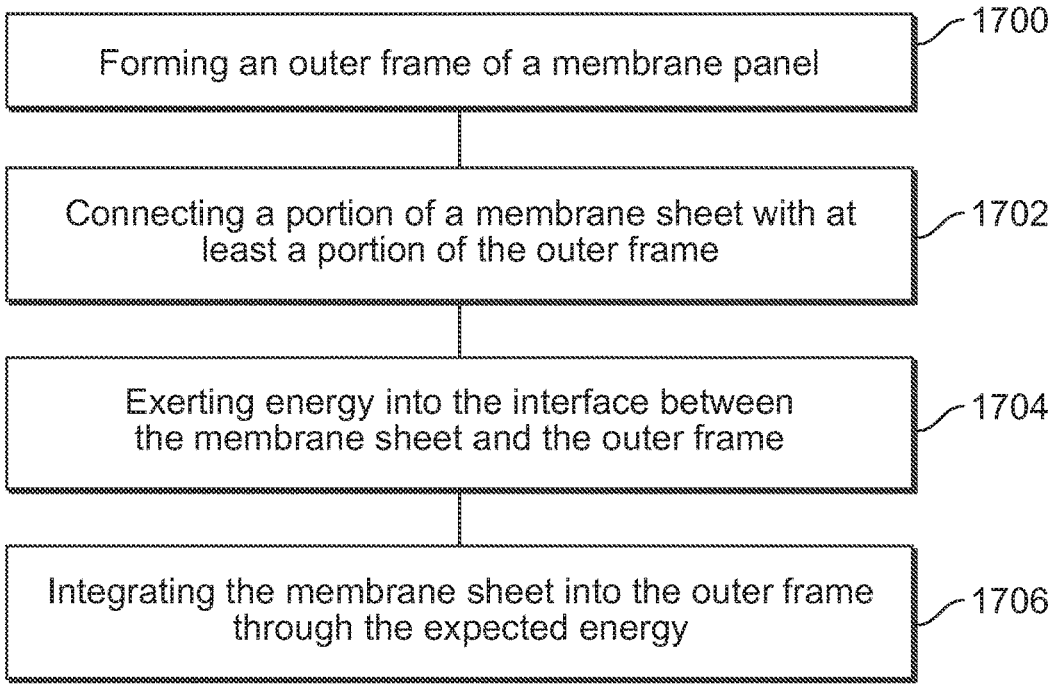
FIG. 24 illustrates a flow chart of a method of forming a membrane panel, according to an embodiment of the present disclosure.

FIG. 24 illustrates a flow chart of a method of forming a membrane panel, according to an embodiment of the present disclosure. The method may begin at 1700, in which an outer frame of the membrane panel is formed. For example, separate and distinct brackets may be securely connected together to form the outer frame. Optionally, the outer frame may be integrally molded and formed through injection-molding.

At 1702, a portion of a membrane sheet may be connected to at least a portion of the outer frame. 1700 and 1702 may simultaneously occur. For example, a membrane sheet may be inserted into a mold, such that edge portions of the membrane sheet are positioned within an internal chamber of the mold. Injection-molded plastic may flow within the internal chamber around the edge portions. Optionally, a membrane sheet may be positioned on top of or below an outer frame.

Next, at 1704, energy is exerted into an interface between the membrane sheet and the outer frame. For example, energy in the form of the heat of the injection-molded plastic may be exerted into the edge portions of the membrane sheet. As the plastic cools and hardens, thereby forming the outer frame, the edge portions of the membrane sheet securely fix to the hardening plastic. Alternatively, energy in the form of ultrasonic, laser, heat, or other such energy may be focused into an interface between the outer frame and the membrane sheet to melt the edge portions to the outer frame, or vice versa. Then, at 1706, the membrane sheet is integrated into the outer frame through the exerted energy.

As described above, embodiments of the present disclosure provide systems and methods of forming membrane panels and energy exchange assemblies. Each membrane panel may include an outer frame integrated or integrally formed with a membrane sheet that is configured to allow energy, such as sensible and/or latent energy, to be transferred therethrough.

In at least one embodiment, a stackable membrane panel is provided. The membrane panel may include an outer frame and a membrane sheet. The outer frame may have two sides and defines an interior opening extending through the outer frame. One or more frame segments define a perimeter of the opening. At least one membrane sheet is configured to be integrated to one or both of the two sides. The membrane sheet covers the opening and is integrated to the outer frame such that the membrane is fully sealed to the one or more frame segments.

In at least one embodiment, a method for constructing an air-to-air membrane heat exchanger is provided. The method includes mounting at least one membrane sheet on one side of an outer frame having a perimeter surrounding an interior opening. The method also includes integrating the membrane to the outer frame so the membrane is sealed to the outer frame along the entire perimeter. The method further includes stacking a plurality of the membrane-integrated outer frames alternately with a plurality of air spacers, the air spacers having channels configured to direct air flow between the membranes of adjacent membrane-integrated outer frames.

The membrane sheet may be integrated to the outer frame by at least one of injection-molding, heat-sealing, ultrasonic welding or bonding, laser welding or bonding, or the like. The membrane sheet may be integrated with the outer frame by a technique other than adhesives or wrapping techniques. A membrane spacer may be configured to be placed between two panels and vertically stacked to form an energy exchange assembly, in which the membrane spacer includes channels configured to direct fluid flow through the assembly.

In at least one embodiment, a membrane sheet may be directly integrated into an outer frame. The membrane sheet may be directly integrated by injection-molding, laser-bonding or welding, heat-sealing, ultrasonic welding or bonding, or the like. The integrating methods ensure that the membrane sheet is sealed around the outer edges, without the need for adhesives, or any wrapping technique. Compared to using adhesives, the systems and methods of forming the membrane panels described above are more efficient, and reduce time and cost of assembly. Further, embodiments of the present disclosure also reduce the potential of release of harmful VOCs.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

It is to be understood that the above description is intended to be illustrative, and not restrictive. For example, the above-described embodiments (and/or aspects thereof) may be used in combination with each other. In addition, ninny modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. An energy exchange assembly comprising:

a first membrane panel including:

a first outer frame defining a first central opening; and a first membrane sheet connected to the first outer frame across the first central opening, the first membrane sheet configured to transfer sensible energy and latent energy therethrough;

a second membrane panel positioned near the first membrane panel, the second membrane panel including:

a second outer frame defining a second central opening; and a second membrane sheet connected to the second outer frame across the second central opening, the second membrane sheet configured to transfer sensible energy and latent energy therethrough; and a membrane spacer positioned between the first and second membrane panels, the membrane spacer including a plurality of connecting brackets positioned between the outer frames of the first and second membrane panels;

wherein the membrane spacer is formed as a rectangular grid including a plurality of rails extending along the length of the spacer, and a plurality of reinforcing beams extending perpendicularly to the rails.

2. The energy exchange assembly of claim 1, wherein the first membrane panel includes an additional membrane sheet, the first membrane sheet integrated into a top surface of the first outer frame, and the additional membrane sheet integrated into a bottom surface of the first outer frame.

3. The energy exchange assembly of claim 1, wherein the first outer frame includes a plurality of end brackets and lateral brackets, each of the end brackets and lateral brackets including inner edges that define the first central opening.

4. The energy exchange assembly of claim 3, wherein one of the inner edges of the end brackets or lateral brackets includes a membrane spacer-securing feature formed therein; the membrane spacer-securing feature securable to the membrane spacer.

5. The energy exchange assembly of claim 1, wherein the first outer frame, the second outer frame, and the connecting bracket are of uniform height.

6. The energy exchange assembly of claim 1, wherein the first and second outer frames each include a plurality of upstanding corners, wherein the connecting brackets are positioned between the upstanding corners of the first and second outer frames.

7. The energy exchange assembly of claim 1, wherein the plurality of connecting brackets include a beveled end having a distal tip that connects to a base by a sloped surface.

8. The energy exchange assembly of claim 1, wherein a foam layer, sealer layer, or adhesive layer is located between the outer frame and the connecting brackets of each of the first and second membrane panels.

9. An energy exchange assembly comprising:

a plurality of membrane panels, each of the plurality of membrane panels including:

an outer frame defining a central opening; and a membrane sheet connected to the outer frame across the central opening, the membrane sheet configured to transfer sensible energy and latent energy therethrough; and a plurality of membrane spacers, each of the plurality of membrane spacers separate from and positioned between the outer frames of two of the plurality of membrane panels, each of the plurality of membrane spacers including a plurality of connecting brackets and formed as a rectangular grid including a plurality of rails extending along the length of the spacer and a plurality of reinforcing beams extending perpendicularly to the rails.

10. The energy exchange assembly of claim 9, wherein a foam layer, sealant layer, or adhesive layer is positioned between the outer frame and the connecting brackets of each of the membrane panels.

11. The energy exchange assembly of claim 9, wherein the outer frame of each of the membrane panels and the connecting brackets of the membrane panels are of uniform height.

12. The energy exchange assembly of claim 9, wherein the outer frames of each of the membrane panels include a plurality of upstanding corners, wherein the connecting brackets are positioned between the upstanding corners of the outer frames.

13. The energy exchange assembly of claim 12, wherein the plurality of connecting brackets include a beveled end having a distal tip that connects to a base by a sloped surface.

14. The energy exchange assembly of claim 9, wherein the membrane sheet is integrated into a top surface of each outer frame of each membrane panel, and an additional membrane sheet is integrated into the bottom surface of each outer frame of each membrane panel.

15. The energy exchange assembly of claim 9, wherein the plurality of membrane spacers and the plurality of membrane panels are arranged in alternating layers to form a membrane stack.

16. The energy exchange assembly of claim 15, wherein the membrane stack is positioned within an outer casing, the outer casing including a base and a plurality of corner beams that extend vertically, the corner beams having first and second ends, wherein the base is connected to the first ends of the corner beams.

17. The energy exchange assembly of claim 16, wherein the outer casing includes a top cover connected to the vertically extending corner beams at the second ends of the corner beams that are opposite the base.

18. The energy exchange assembly of claim 17, wherein a first foam layer is positioned between the top cover and the membrane stack, and a second foam layer is positioned between the base and the membrane stack.

19. The energy exchange assembly of claim 18, wherein the stacking frame includes: a base, a plurality of vertical corner beams, intermediate beams, and horizontal cross members, one end of the vertically extending corner and intermediate beams are connected to the base, and the horizontal cross beams and intermediate beams position individual membrane stacks within the stacking frame.

20. The energy exchange assembly of claim 15, wherein a plurality of membrane stacks are mounted within a stacking frame.

21. The energy exchange assembly of claim 19, wherein the stacking frame further includes a top cover connected to an end of the vertically extending corner beams and intermediate beams opposite the base.

22. The energy exchange assembly of claim 15, wherein a first foam layer is positioned between each corner beam and each membrane stack, and a second foam layer is positioned between each intermediate beam and each membrane stack.

* * * * *